US007614638B2

(12) United States Patent
Cunningham et al.

(10) Patent No.: US 7,614,638 B2
(45) Date of Patent: Nov. 10, 2009

(54) CONVERTIBLE TOE STRAP

(75) Inventors: Christopher Cunningham, Burlington, VT (US); Christopher Doyle, Waterbury, VT (US); Noah Decker, Burlington, VT (US); Bryan Davis, St. George, VT (US)

(73) Assignee: The Burton Corporation, Burlington, VT (US)

( * ) Notice: Subject to any disclaimer, the term of this patent is extended or adjusted under 35 U.S.C. 154(b) by 923 days.

(21) Appl. No.: 10/910,262

(22) Filed: Aug. 2, 2004

(65) Prior Publication Data

US 2006/0022432 A1 Feb. 2, 2006

(51) Int. Cl.
*A63C 9/00* (2006.01)

(52) U.S. Cl. ..... 280/617; 280/11.31; 280/616; 280/633; 280/611; 280/14.22

(58) Field of Classification Search ..... 280/11.31, 280/14.22, 616, 617, 611, 633
See application file for complete search history.

(56) References Cited

U.S. PATENT DOCUMENTS

| | | | | |
|---|---|---|---|---|
| 58,367 | A | | 10/1866 | Arvine |
| 287,820 | A | | 11/1883 | Gallaher |
| 294,182 | A | | 2/1884 | Barney |
| 301,333 | A | | 7/1884 | Brown |
| 331,977 | A | | 12/1885 | King |
| 906,281 | A | | 12/1908 | Plimpton |
| 1,280,505 | A | * | 10/1918 | Lowe ..... 280/11.31 |
| 1,439,806 | A | | 12/1922 | Elias |
| 1,815,168 | A | | 7/1931 | Sprague |
| 1,944,664 | A | | 1/1934 | Maxcy |
| 2,037,964 | A | | 4/1936 | Chochkoff |
| 2,072,477 | A | | 3/1937 | Dodd |
| 2,153,809 | A | | 4/1939 | Meis |
| 2,201,990 | A | | 5/1940 | Dekome et al. |
| 2,531,763 | A | | 11/1950 | Andre |
| 2,546,694 | A | | 3/1951 | Johansen |
| 2,643,888 | A | | 6/1953 | Hargis, Jr. |
| 2,679,401 | A | | 5/1954 | Williams |
| 2,685,141 | A | | 8/1954 | Davenport |
| 2,740,972 | A | | 4/1956 | Taylor |
| 2,950,118 | A | | 8/1960 | Sharpe |
| 2,987,834 | A | | 6/1961 | Howe |

(Continued)

FOREIGN PATENT DOCUMENTS

| | | |
|---|---|---|
| CA | 1001676 | 12/1976 |

(Continued)

OTHER PUBLICATIONS

Pages from a DNR Sportsystem Ltd. Catalog.

(Continued)

*Primary Examiner*—Lesley D Morris
*Assistant Examiner*—Katy Meyer
(74) *Attorney, Agent, or Firm*—Wolf, Greenfield & Sacks, P.C.

(57) ABSTRACT

A convertible toe strap for securing a toe area of a snowboarding boot is selectively and repeatedly convertible between different restraining configurations. The convertible toe strap includes a first configuration where one of toe lift or forward movement is resisted and a second configuration where both toe lift and forward movement is resisted.

26 Claims, 14 Drawing Sheets

U.S. PATENT DOCUMENTS

| | | | | |
|---|---|---|---|---|
| 3,143,750 | A | 8/1964 | Kluge | |
| 3,228,707 | A | 1/1966 | Davis et al. | |
| 3,241,153 | A | 3/1966 | Brewer | |
| 3,570,148 | A | 3/1971 | Morgan | |
| 3,618,235 | A | 11/1971 | Cary, Jr. | |
| 3,747,239 | A | 7/1973 | Green | |
| 3,751,832 | A | 8/1973 | Baryluk | |
| 4,004,355 | A | 1/1977 | Koblick | |
| 4,160,332 | A | 7/1979 | Salomon | |
| 4,201,395 | A | 5/1980 | Matejec et al. | |
| 4,314,707 | A | 2/1982 | Welch | |
| 4,468,045 | A | 8/1984 | Sarazen | |
| 4,624,063 | A | 11/1986 | Delery | |
| 4,624,064 | A | 11/1986 | Pozzebon | |
| 4,638,685 | A | 1/1987 | Cigolini | |
| 4,649,657 | A | 3/1987 | Iwama | |
| 4,772,041 | A | 9/1988 | Klosterman | |
| 4,839,972 | A | 6/1989 | Pack et al. | |
| 4,871,186 | A | 10/1989 | Klosterman | |
| 4,887,833 | A | 12/1989 | Bailey | |
| 4,914,839 | A | 4/1990 | Paris et al. | |
| 4,969,655 | A | 11/1990 | Katz | |
| 4,979,760 | A | 12/1990 | Derrah | |
| 5,088,212 | A | 2/1992 | Trinkaus et al. | |
| 5,097,687 | A | 3/1992 | Turrin et al. | |
| 5,172,924 | A | 12/1992 | Barci | |
| 5,205,055 | A | 4/1993 | Herrell | |
| 5,234,230 | A | 8/1993 | Crane et al. | |
| 5,277,635 | A | 1/1994 | Gillis | |
| 5,368,320 | A | 11/1994 | Teeter et al. | |
| 5,400,529 | A | 3/1995 | Bell et al. | |
| 5,401,041 | A | 3/1995 | Jespersen | |
| 5,409,244 | A | 4/1995 | Young | |
| 5,410,822 | A | 5/1995 | Vaccari | |
| 5,435,080 | A | 7/1995 | Meiselman | |
| 5,459,949 | A | 10/1995 | MacPhail | |
| 5,480,176 | A | 1/1996 | Sims | |
| 5,505,477 | A | 4/1996 | Turner et al. | |
| 5,553,400 | A | 9/1996 | Wittmann et al. | |
| 5,556,123 | A | 9/1996 | Fournier | |
| 5,570,522 | A | 11/1996 | Olson | |
| 5,581,912 | A | 12/1996 | Adams | |
| 5,590,481 | A | 1/1997 | Vaccari | |
| 5,609,347 | A | 3/1997 | Dressel | |
| 5,624,291 | A | 4/1997 | McClaskey | |
| 5,692,765 | A | 12/1997 | Laughlin | |
| 5,718,066 | A | 2/1998 | Chemello et al. | |
| 5,727,797 | A | 3/1998 | Bowles | |
| 5,758,895 | A | 6/1998 | Bumgarner | |
| 5,769,444 | A | 6/1998 | Mason | |
| 5,769,446 | A | 6/1998 | Borsoi | |
| 5,779,259 | A | 7/1998 | Lin | |
| 5,794,360 | A | 8/1998 | Bell et al. | |
| 5,813,689 | A | 9/1998 | Mansure | |
| 5,816,603 | A | 10/1998 | Borsoi | |
| 5,820,139 | A | 10/1998 | Grindl | |
| 5,823,563 | A | 10/1998 | Dubuque | |
| 5,836,592 | A | 11/1998 | Chang | |
| 5,845,371 | A | 12/1998 | Chen | |
| 5,857,700 | A | 1/1999 | Ross | |
| 5,901,971 | A | 5/1999 | Eaton | |
| 5,909,894 | A | 6/1999 | Meader et al. | |
| 5,918,387 | A | 7/1999 | Emerson | |
| 5,918,897 | A | 7/1999 | Hansen et al. | |
| 5,927,744 | A | 7/1999 | Knapschafer | |
| 5,947,781 | A | 9/1999 | Vanwald et al. | |
| 5,971,407 | A | 10/1999 | Zemke et al. | |
| 5,971,423 | A | 10/1999 | Hansen et al. | |
| 5,984,325 | A | 11/1999 | Acuna | |
| 6,032,974 | A | 3/2000 | Saillet | |
| 6,045,144 | A * | 4/2000 | Wong | 280/11.26 |
| 6,056,300 | A | 5/2000 | Carpenter et al. | |
| 6,065,770 | A | 5/2000 | Hansen et al. | |
| 6,076,848 | A | 6/2000 | Rigal et al. | |
| 6,113,114 | A * | 9/2000 | Zemke et al. | 280/14.26 |
| 6,145,853 | A | 11/2000 | Croshaw | |
| 6,224,070 | B1 | 5/2001 | Carpenter et al. | |
| 6,250,651 | B1 | 6/2001 | Reuss et al. | |
| 6,273,450 | B1 | 8/2001 | Challande et al. | |
| 6,293,566 | B1 | 9/2001 | Carpenter et al. | |
| 6,293,577 | B1 | 9/2001 | Shields | |
| 6,347,805 | B1 | 2/2002 | Maravetz et al. | |
| 6,390,492 | B1 | 5/2002 | Bumgarner et al. | |
| 6,394,484 | B1 | 5/2002 | Maravetz et al. | |
| 6,405,457 | B1 | 6/2002 | Basso et al. | |
| 6,412,794 | B1 | 7/2002 | Phillips et al. | |
| 6,416,075 | B1 | 7/2002 | Laughlin et al. | |
| 6,422,048 | B1 | 7/2002 | Fontes et al. | |
| 6,481,070 | B2 | 11/2002 | Caeran et al. | |
| 6,488,290 | B2 | 12/2002 | Carpenter et al. | |
| 6,527,293 | B1 | 3/2003 | Roy et al. | |
| 6,533,295 | B2 | 3/2003 | Gonthier | |
| 6,543,159 | B1 | 4/2003 | Carpenter et al. | |
| 6,554,297 | B2 * | 4/2003 | Phillips et al. | 280/14.22 |
| 6,581,944 | B1 | 6/2003 | Marmonier et al. | |
| 6,595,541 | B2 | 7/2003 | Kuchler | |
| 6,604,746 | B1 | 8/2003 | Sato et al. | |
| 6,644,681 | B2 | 11/2003 | Couderc et al. | |
| 6,669,211 | B2 | 12/2003 | Gonthier | |
| 6,676,152 | B2 | 1/2004 | Gonthier | |
| 6,678,894 | B2 | 1/2004 | Norbutt | |
| 6,679,515 | B2 | 1/2004 | Carrasca | |
| 6,679,516 | B2 | 1/2004 | Andrevon | |
| 6,694,644 | B2 | 2/2004 | Haupt | |
| 6,705,633 | B2 | 3/2004 | Poscich | |
| 6,709,003 | B2 * | 3/2004 | Laughlin et al. | 280/623 |
| 6,715,773 | B2 | 4/2004 | Aiken | |
| 6,719,304 | B2 | 4/2004 | Miller et al. | |
| 6,722,688 | B2 | 4/2004 | Poscich | |
| 6,726,238 | B2 | 4/2004 | Poscich | |
| 6,729,642 | B2 | 5/2004 | Gouzes et al. | |
| 6,739,615 | B1 | 5/2004 | Maravetz et al. | |
| 6,748,630 | B2 | 6/2004 | Livingston | |
| 6,773,020 | B2 | 8/2004 | Gonthier | |
| 7,011,333 | B2 * | 3/2006 | Pascal | 280/617 |
| 2001/0001906 | A1 | 5/2001 | Borosi | |
| 2001/0003394 | A1 | 6/2001 | Gonthier | |
| 2001/0010418 | A1 | 8/2001 | Gonthier | |
| 2002/0011718 | A1 | 1/2002 | Couderc et al. | |
| 2002/0036386 | A1 | 3/2002 | Murphy et al. | |
| 2002/0041081 | A1 | 4/2002 | Gonthier | |
| 2002/0084604 | A1 | 7/2002 | Phillips et al. | |
| 2002/0163162 | A1 | 11/2002 | Haupt | |
| 2002/0190502 | A1 | 12/2002 | Naito | |
| 2002/0190503 | A1 | 12/2002 | Laughlin et al. | |
| 2003/0001352 | A1 | 1/2003 | Dornan | |
| 2003/0098569 | A1 | 5/2003 | Gonthier | |
| 2003/0102652 | A1 | 6/2003 | Taylor et al. | |
| 2003/0127832 | A1 * | 7/2003 | Couderc et al. | |
| 2003/0154631 | A1 | 8/2003 | Hirayama | |
| 2003/0164605 | A1 | 9/2003 | Maravetz et al. | |
| 2003/0201623 | A1 | 10/2003 | Pascal | |
| 2003/0201624 | A1 | 10/2003 | Pascal | |
| 2003/0205871 | A1 | 11/2003 | Coburn et al. | |
| 2004/0021278 | A1 | 2/2004 | Lyden | |
| 2004/0061311 | A1 | 4/2004 | De Bortoli et al. | |
| 2004/0075246 | A1 | 4/2004 | Davies | |
| 2004/0094917 | A1 | 5/2004 | Frigo et al. | |
| 2004/0119251 | A1 | 6/2004 | Chen | |
| 2004/0135348 | A1 * | 7/2004 | Naito et al. | |
| 2004/0145128 | A1 | 7/2004 | Couderc | |
| 2004/0164521 | A1 | 8/2004 | Sato | |
| 2004/0164522 | A1 | 8/2004 | Gonthier | |
| 2004/0169343 | A1 | 9/2004 | Fougere | |

| | | | |
|---|---|---|---|
| 2004/0169350 | A1 | 9/2004 | Elkington |
| 2004/0169351 | A1 | 9/2004 | Cole, III |
| 2004/0181972 | A1 | 9/2004 | Csorba |
| 2004/0181973 | A1 | 9/2004 | Meibock |
| 2004/0207179 | A1 | 10/2004 | Sacco et al. |
| 2004/0211091 | A1 | 10/2004 | Heierling |
| 2004/0239078 | A1 | 12/2004 | Messmer |
| 2004/0261298 | A1 | 12/2004 | Howard |
| 2005/0022427 | A1 | 2/2005 | Kerns |
| 2005/0104330 | A1 | 5/2005 | Sauter |

FOREIGN PATENT DOCUMENTS

| | | | |
|---|---|---|---|
| CA | 1019145 | | 10/1977 |
| CA | 2030429 | | 5/1992 |
| CH | 244825 | | 8/1945 |
| CH | 264893 | | 6/1948 |
| DE | 91 13 766 | U1 | 4/1992 |
| DE | 44 16 024 | | 10/1995 |
| DE | 44 35 113 | C1 | 5/1996 |
| DE | 195 24 457 | A | 1/1997 |
| EP | 0020315 | | 12/1980 |
| EP | 0 217 750 | A1 | 4/1987 |
| EP | 0705544 | A1 | 4/1996 |
| EP | 0793983 | A1 | 10/1997 |
| EP | 0797936 | A1 | 10/1997 |
| EP | 0824942 | A1 | 2/1998 |
| EP | 0839557 | A1 | 5/1998 |
| EP | 1228788 | A | 7/2002 |
| FR | 2592807 | | 7/1987 |
| JP | 6-319601 | A | 11/1992 |
| JP | 05068602 | A | 3/1993 |
| JP | 3032704 | | 10/1996 |
| JP | 8256802 | | 10/1996 |
| JP | 2001-161886 | A | 6/2001 |
| JP | 2004-147808 | A | 5/2004 |
| JP | 2004-154593 | | 6/2004 |
| NO | 60109 | | 9/1937 |
| WO | WO 94/21339 | | 9/1994 |
| WO | WO 95/33534 | | 12/1995 |
| WO | WO 96/36406 | A1 | 11/1996 |
| WO | WO 97/28859 | | 8/1997 |
| WO | WO 97/31687 | A1 | 9/1997 |
| WO | WO 97/35494 | | 10/1997 |
| WO | WO 97/38764 | | 10/1997 |
| WO | WO 99/15245 | | 4/1999 |
| WO | WO 2004/062751 | | 7/2004 |
| WO | WO 2005/049156 | | 6/2005 |

OTHER PUBLICATIONS

Pages from a Flow Catalog.
Santa Cruz Snowboards brochure 96/97 (3 pp.)
Santa Cruz Snowboards brochure, 96 (3 pp.).
Press Release, "Burton, Technine Share Binding Technology"; www.transworldsnowboarding.com, Jan. 5, 2004, printed Jan. 6, 2004.
European Search Report dated Apr. 7, 1998 for EP 98100144.
International Search Report dated May 26, 2004 for PCT/US03/41257.
Product listing for "Bindings" downloaded from www.burton.com/burton/gear/bindings/ca_bindings.asp on Aug. 2, 2004, p. 1.
Product listing for "Capstrap" downloaded from www.burton.com/burton/gear/products.asp?productID=56 on Aug. 2, 2004, p. 1.

* cited by examiner 86C
86B
86A
86

24
84
75
85
22
10
74
82
83
68
16
88
92
18
93
54

CONVERTIBLE TOE STRAP

BACKGROUND OF INVENTION

1. Field of Invention

The invention relates to straps and strap bindings for engaging snowboard boots.

2. Discussion of Related Art

Strap type bindings for securing a snowboarding boot of a rider to a snowboard are known and typically include one or more straps, such as an ankle strap and/or a toe strap, which may be incrementally tightened across the top of the boot to firmly secure the rider to the board. A conventional toe strap includes an elongated strip, slightly bowed, that extends across the top of the boot, leaving the rounded front end of the boot projecting beyond the edge of the toe strap so that it is not directly contacted by the toe strap when the boot is secured into the binding. Such a toe strap bears down on the top of the boot to prevent toe lift.

Some riders have modified the toe strap position so that rather than extending across the top of the boot, the strap runs around the front toe face of the boot. By sliding the toe strap forward and down, so that it abuts the forward-most surface of the snowboarding boot, and then tightening the strap, the snowboarding boot is cinched firmly back into the heel cup of the binding.

To allow a rider to simultaneously pull the boot back into the heel cup and prevent toe lift, cup-like toe straps have been developed, such as, for example, the Capstrap™ toe strap, available from Burton Snowboards, located in Burlington, Vt. These straps include a top surface that inhibits the toe area of the boot from rising vertically off the binding, and a front surface that constrains forward movement of the boot.

SUMMARY OF INVENTION

In one aspect, a toe strap can be converted, repeatedly, between one configuration where toe lift or forward movement is inhibited and another configuration where both toe lift and forward movement are inhibited.

According to one aspect, a convertible toe strap for securing a toe area of a snowboarding boot is provided. The toe area of the boot has a top surface that is adapted to be positioned above a rider's foot, a bottom surface adapted to be positioned below a rider's foot and a front wall extending therebetween and adapted to be positioned in front of the rider's foot. The convertible toe strap includes a first configuration conformable to one of the top surface and arranged to resist upward movement, or the front wall of the boot and arranged to resist forward movement; and a second configuration conformable to both the top surface and front wall and arranged to resist both upward movement and forward movement. The toe strap is selectively and repeatedly convertible between the first configuration and the second configuration.

According to another aspect, a convertible toe strap for securing a toe area of a snowboarding boot is provided. The toe area of the boot has a top surface that is adapted to be positioned above a rider's foot, a bottom surface adapted to be positioned below a rider's foot and a front wall extending therebetween and adapted to be positioned in front of the rider's foot. The convertible toe strap includes a first configuration conformable to one of the top surface and arranged to resist upward movement, or the front wall of the boot and arranged to resist forward movement; and a second configuration conformable to both the top surface and front wall and arranged to resist both upward movement and forward movement. The strap further comprises a means for selectively and repeatedly converting the toe strap between the first configuration and the second configuration.

According to yet another aspect, a convertible toe strap for securing a toe area of a snowboarding boot is provided. The toe area of the boot has a top surface that is adapted to be positioned above a rider's foot, a bottom surface adapted to be positioned below a rider's foot and a front wall extending therebetween and adapted to be positioned in front of the rider's foot. The convertible toe strap includes a first strap portion conformable to one of the top surface or the front wall; and a second strap portion conformable to the other of the top surface or front wall. T toe strap is selectively and repeatedly convertible between a first configuration wherein the first strap portion is arranged to resist upward movement or to resist forward movement and a second configuration wherein the first and second strap portions cooperate to resist both upward movement and forward movement. When in either configuration, both strap portions conform to the boot.

According to yet another aspect, a convertible toe strap for securing a toe area of a snowboarding boot is provided. The toe area of the boot has a top surface that is adapted to be positioned above a rider's foot, a bottom surface adapted to be positioned below a rider's foot and a front wall extending therebetween and adapted to be positioned in front of the rider's foot. The convertible toe strap includes a first strap portion conformable to one of the top surface or to the front wall, the first strap portion engageable with a mating engagement element to tighten the strap against the boot; and a second strap portion conformable to the other of the top surface or front wall. The toe strap is selectively and repeatedly convertible between a first configuration wherein the first strap portion is arranged to resist upward movement or to resist forward movement and a second configuration wherein the first and second strap portions cooperate to resist both upward movement and forward movement. When in either configuration, the first strap portion conforms to the boot.

According to yet another aspect, a convertible toe strap for securing a toe area of a snowboarding boot is provided. The toe area of the boot has a top surface that is adapted to be positioned above a rider's foot, a bottom surface adapted to be positioned below a rider's foot and a front wall extending therebetween and adapted to be positioned in front of the rider's foot. The convertible toe strap includes a first strap portion engageable with one of the top surface or the front wall, an end of the first strap portion engageable with a mating engagement element to tighten the strap against the boot; and a second strap portion engageable with the other of the top surface or front wall. The toe strap is selectively and repeatedly convertible between a first configuration wherein the first strap portion is arranged to resist upward movement or to resist forward movement and a second configuration wherein the first and second strap portions cooperate to resist both upward movement and forward movement. When in either configuration, the end of the first strap portion engageable with the mating engagement element aligns with the mating engagement element.

According to yet another aspect, a method for selectively securing a toe area of a snowboarding boot to a binding or binding interface with a strap is provided. The toe area of the boot has a top surface that is adapted to be positioned above a rider's foot, a bottom surface adapted to be positioned below a rider's foot and a front wall extending therebetween and adapted to be positioned in front of the rider's foot. The method includes acts of selecting a desired restraining configuration comprising one of a first configuration wherein the strap is arranged to resist upward or forward movement, and a second configuration wherein the toe strap is arranged to resist both upward and forward movement; converting the toe strap into one of the selected configurations; and tightening the strap about the toe area of the boot to secure the toe area to the binding or binding interface.

According to yet another aspect, a convertible strap portion for attachment to a first toe strap portion to secure a toe area of a snowboarding boot is provided. The toe area of the boot having a top surface that is adapted to be positioned above a rider's foot, a bottom surface adapted to be positioned below a rider's foot and a front wall extending therebetween and adapted to be positioned in front of the rider's foot, the first toe strap portion constructed and arranged to engage one of the top surface or front wall. The convertible strap portion includes a boot-engaging strap portion constructed and arranged to engage the other of the top surface or front wall; and an attachment feature coupled to the boot-engaging strap portion. The attachment feature is constructed and arranged to attach the boot-engaging strap portion with the first toe strap portion.

According to yet another aspect, a convertible strap portion for attachment to a first toe strap portion to secure a toe area of a snowboarding boot is provided. The toe area of the boot has a top surface that is adapted to be positioned above a rider's foot, a bottom surface adapted to be positioned below a rider's foot and a front wall extending therebetween and adapted to be positioned in front of the rider's foot, the first toe strap portion constructed and arranged to engage one of the top surface or front wall. The convertible strap portion includes a boot-engaging strap portion constructed and arranged to engage the other of the top surface or front wall; and a means for attaching the boot-engaging portion with the first strap portion.

According to yet another aspect, a convertible toe strap for securing a toe area of a snowboarding boot is provided. The toe area of the boot has a top surface that is adapted to be positioned above a rider's foot, a bottom surface adapted to be positioned below a rider's foot and a front wall extending therebetween and adapted to be positioned in front of the rider's foot. The convertible toe strap includes a first configuration arranged to resist one of upward movement of the toe area in a direction away from the top surface, or forward movement of the toe area in a direction away from the front wall and a second configuration arranged to resist both upward movement and forward movement. In the first configuration, the strap has a first profile before a force is exerted on the strap and in the second configuration, the strap has a second profile before a force is exerted on the strap, with the first profile being reduced as compared to the second profile.

Various embodiments of the present invention provide certain advantages. Not all embodiments of the invention share the same advantages and those that do may not share them under all circumstances.

Further features and advantages of the present invention, as well as the structure of various embodiments of the present invention are described in detail below with reference to the accompanying drawings.

BRIEF DESCRIPTION OF DRAWINGS

The accompanying drawings are not intended to be drawn to scale. In the drawings, similar features are represented by like reference numerals. For clarity, not every component is labeled in every drawing. In the drawings:

FIG. 3O is a perspective view of another embodiment of a convertible toe strap;

DETAILED DESCRIPTION

Figure 1A:
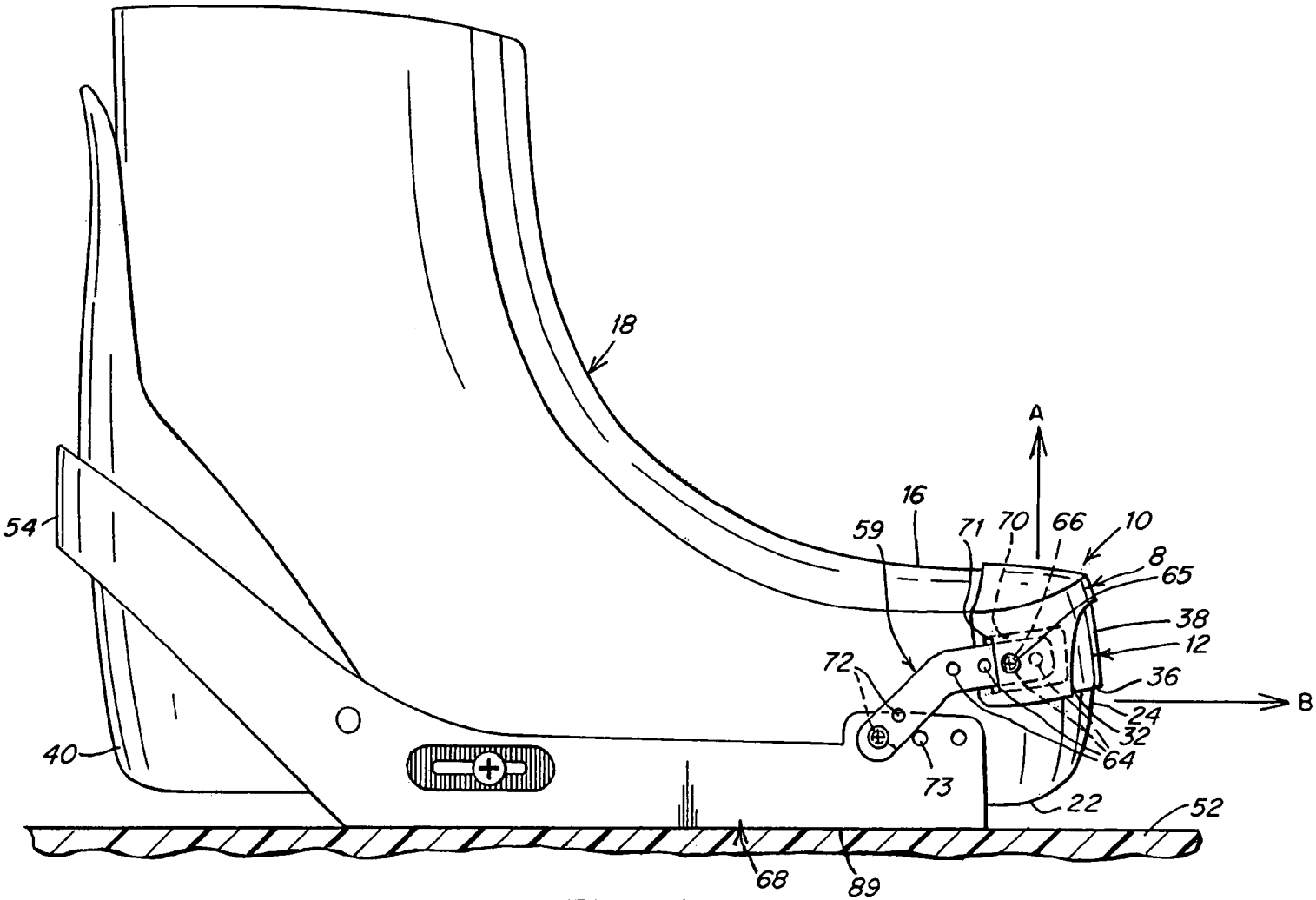
FIGS. 1A and 1B are side views of a convertible toe strap in two different configurations attached to a snowboard binding and engaging a portion of a snowboard boot.

A convertible toe strap is provided where the toe strap can be converted between a first restraining configuration and a second restraining configuration that is different from the first. In the first restraining configuration, the convertible toe strap is constructed and arranged to engage a snowboard boot and limit movement in either a first direction (e.g., toe lift) or a second direction (e.g. forward movement). In the second configuration, the convertible toe strap is constructed and arranged to restrict movement in both directions. In this manner, a snowboard rider can select a desired restraining position and using the convertible toe strap, locate or otherwise configure the toe strap to secure the boot in the desired position. Further, the rider can repeatedly switch between configurations as desired. The conversion between the first and second configurations can be accomplished in a variety of different ways. In some embodiments, conversion occurs by physically attaching/detaching first and second strap components together. In this regard, the strap components may be coupled together using tool-free arrangements, such as pockets, buttons, snaps, loops, zippers, hooks or other attachment devices; alternatively, the strap components may be coupled together by tool-dependent means, such as screws, as the present invention is not limited in this respect. In other embodiments, the strap may be a unitary component where conversion occurs by moving one portion relative to another to change the shape of the strap. In yet other embodiments, at least a part of the strap may be made of a malleable material, such as an elastically deformable material, and may stretch/contract to convert between configurations. In some embodiments, when the strap is in the first configuration, the strap has a reduce profile before a force is exerted on the strap as compared to the profile when the strap is in the second configuration. In this regard, when no load is applied to the strap and when in the first configuration, the strap is similar to a conventional toe strap, being elongated and slightly bowed. When no load is applied to the strap and the strap is in the second, expanded profile configuration, the strap includes a cup-shaped surface.

In one or more embodiments, the conversion occurs by removing the strap from the boot and/or binding, converting the strap to the new configuration, then re-engaging the strap with the boot. Alternatively, the strap may be converted between configurations while still on the boot and/or binding.

It should be appreciated that the strap can be converted from the first configuration to the second configuration by any method or arrangement, as the present invention is not intended to be limiting in this respect.

The convertible toe strap and/or its components may be rigid and shaped to conform to the surface of the snowboard boot which they overlie, may be flexible and resilient to conform to the surface of the boot as the convertible toe strap is tightened down, or may be of any other suitable construction. Constructing the toe strap so that it conforms to the boot may provide certain advantages. For example, a relatively smooth transition across the top and/or forward wall of the boot may eliminate or at least minimize gaps between the strap and surface of the boot. Pressure points on the rider's foot may also be reduced or eliminated. Also, this conformability aids in keeping the ends of the strap near the mounting elements (e.g., buckle and/or ratchet tongue) in line with the remainder of strap, thereby reducing the likelihood that the strap end will twist and misalign with mating engagement elements on the binding, for example. Such misalignment can cause, for example, asymmetric buckle loading between the teeth of the ratchet tongue and buckle, whereby less than the full surface of the ratchet tooth is engaged, which may damage or otherwise decrease the amount the strap can be tightened and/or can cause the strap to slip at high loads. It should be appreciated that these advantages are exemplary only and one or more need not be present in any strap embodiment.

In some embodiments, portions of the strap may be molded from plastic or other suitable material into any desired shape. Alternatively, portions may be formed of leather, simulated leather, fabric or other suitable material or any combination thereof and may be stitched or glued into any desired shape.

Further, some portions of the strap may be stronger and/or stiffer than other portions, which may be desirable as certain portions of the strap may carry more tensile load when tightened than other portions. This may be accomplished by forming sections with a single, relatively strong layer or with multiple layers of the same or dissimilar materials to provide the desired strength characteristics. Strengthening inserts may also be employed.

The convertible toe strap can be used in any of numerous applications, including for use as a strap attached directly to a snowboard boot, as a strap for at least partially securing a boot to a snowboard binding, or as a strap for at least partially securing a boot to a binding interface.

Figure 1B:
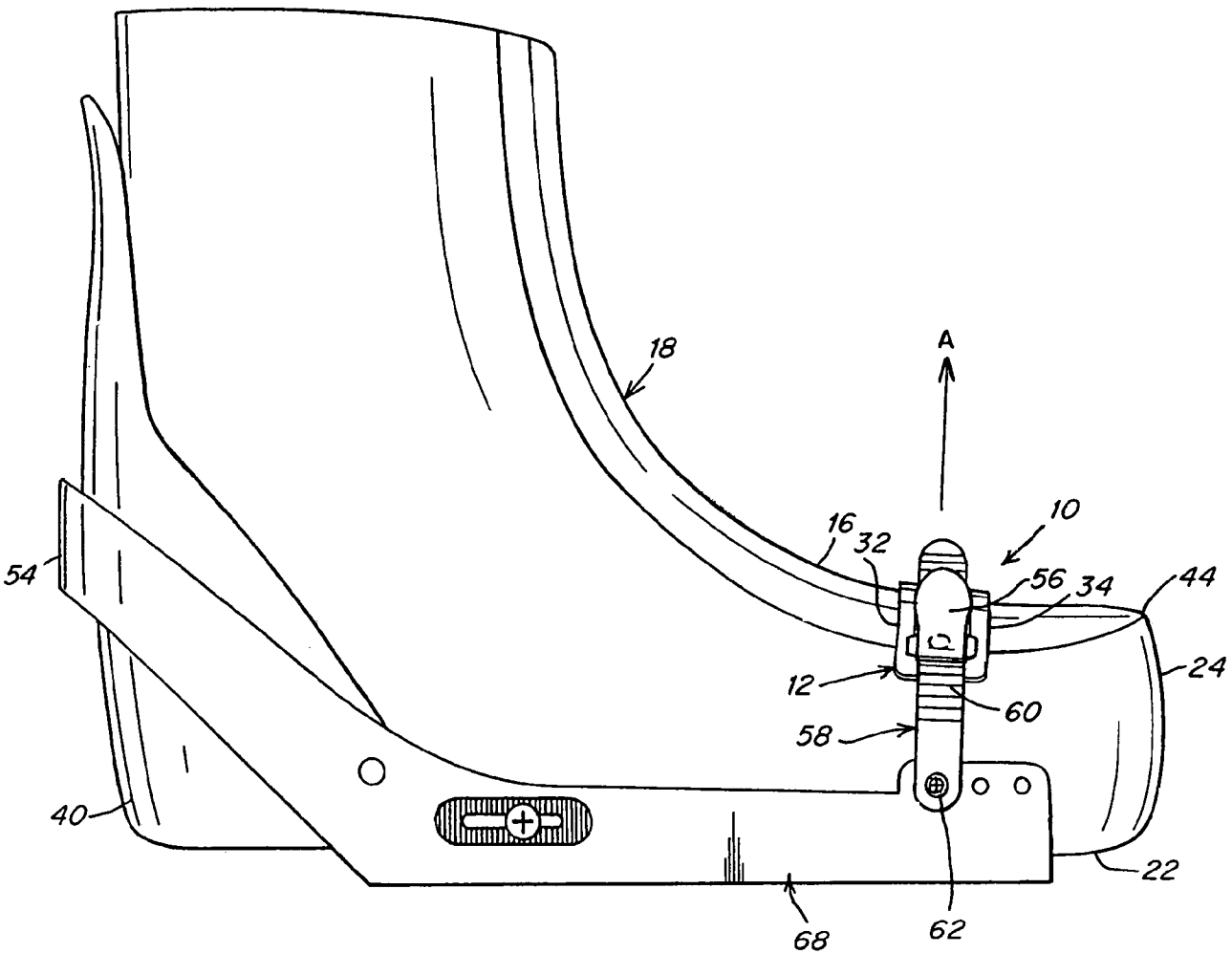

A convertible toe strap 10 in accordance with one illustrative embodiment is shown in FIGS. 1A-1B and 2A-2D. As shown in FIG. 1A and 1B, the convertible toe strap can convert between a first boot-engaging configuration where it restricts movement of a boot 18 in the upward (A) direction to limit toe lift (FIG. 1B) and a second boot-engaging configuration where it restricts movement of the boot 18 in both a forward (B) and upward (A) direction (FIG. 1A). The convertible toe strap 10 is formed with a first toe strap portion 12 selectively attachable to a second strap portion 8. The first toe strap portion 12 is configured in a manner similar to a conventional toe strap, being elongated and slightly bowed, and including a surface that can engage the top surface 16 of the boot 18 forward of an instep area of the boot when applied in the first boot-engaging configuration. When tightened, the strap exerts a downward force on the top surface 16 of the boot 18 that acts to resist toe lift.

The second strap portion 8 is employed when the toe strap 10 is to be used in the second configuration. In this regard, the second strap portion 8 is adapted to couple to the first strap portion 12 so that both cooperate to engage and hold down the front top of the boot and to cinch the boot in the heel direction. The second portion 8 includes an upper boot-engaging section or wall 14 that is adapted to engage a top surface 16 of the boot 18 that sits above a wearer's toes and that is generally parallel to the boot sole 22. The first strap portion 12 is now positioned to engage the front or forward wall 24 of the boot that extends between the top surface 16 and bottom surface 22 (e.g., sole). When tightened, the strap 10 exerts a downward force on the top surface 16 of the boot as well as on the forward wall 24 of the boot 18. In one embodiment, the force exerted on the forward wall 24 is greater than that exerted on the top surface 16.

Figure 2A:
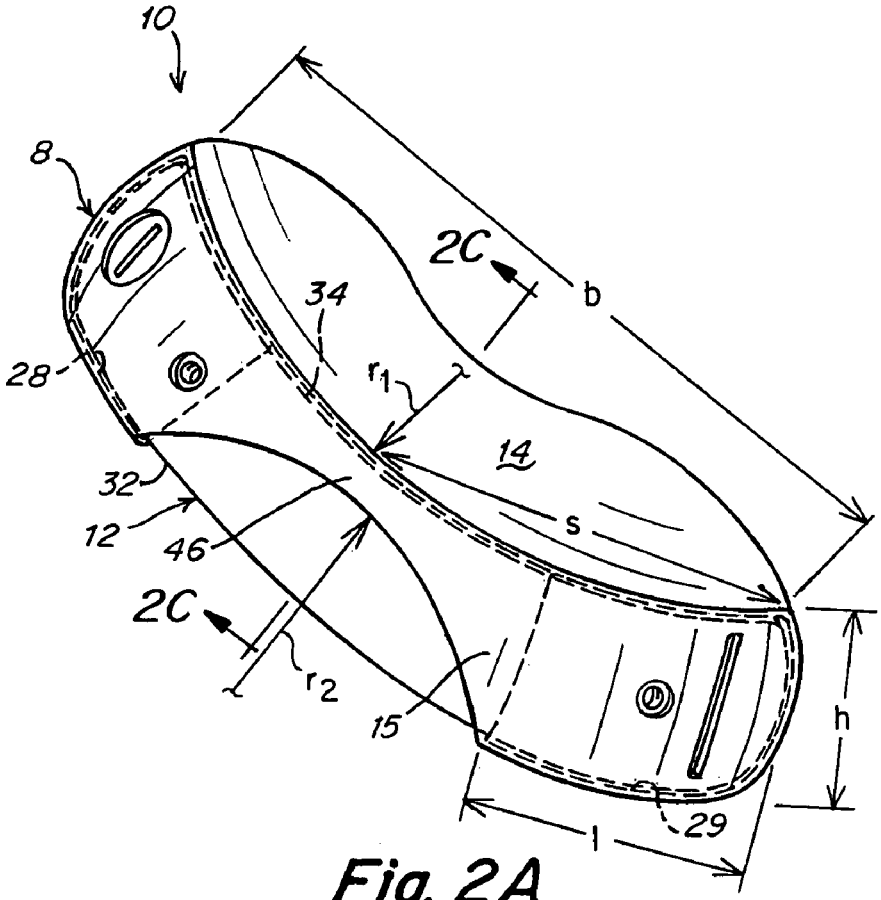
FIG. 2A is a perspective view of one embodiment of a convertible toe strap.

To attach the first and second strap portions together, in one embodiment, the second strap portion includes a forward and downwardly extending attachment section 15 coupled to the upper section 14. Section 15 includes at least one pocket and preferably two pockets 28, 29 on either end to receive the ends of the first strap portion 12, as shown in FIG. 2A. In this embodiment, the strap is adjustably tightened using suitable mounting straps and ratcheting buckles, with the buckle fastened to the toe strap. Thus, to convert the strap into the second configuration in this embodiment, the first strap portion is loosened, disconnected from the mounting straps, and detached from the buckle. The ends of the first strap portion are then inserted into the pockets formed on the ends of the downwardly extending section of the second strap portion. The buckle and straps are once again attached to the ends of the first strap portion and the strap is positioned such that the first strap portion engages the forward wall 24 (rather than the top surface 16) and the second strap portion 8 engages the top surface 16. The strap may then be adjustably mounted to the binding and, as tightened, the boot is cinched rearward and held downward such that both toe lift and forward movement are restrained.

To accommodate attachment of the ends of the first strap portion to the buckle and strap when the first strap portion is attached to the second strap portion, apertures may be formed through the pockets. Alternatively, the pockets may be sized and shaped so as to not interfere with the attachment of the buckle and straps yet engage the ends of the first strap portion to grasp on to the first strap portion, such that the buckle and/or mounting strap may remain attached during the conversion.

It should be appreciated that the present invention is not limited to repositioning the first strap portion from a position on top of the boot to a position to engage the forward wall of the boot while the second portion engages the top surface of the boot. Thus, in another embodiment (not shown), the toe strap portion 12 can maintain its position engaging the top surface of the boot when the toe strap is in either configuration. In this embodiment, then, the second toe strap portion is attached to the first strap portion such that the second strap portion engages the forward wall. Thus, while the toe lift and forward movement are still restricted, the roles of the two strap portions in this embodiment are reversed.

The construction of the second toe strap portion 8 will now be described in more detail with reference to FIGS. 2A-2D. The upper section 14 of the strap portion 8 includes a forward edge 17, a rearward edge 19, a bottom surface 33, and a top surface 41, as shown in the cross-sectional view of FIG. 2C. When engaging a boot 18, bottom surface 33 is positioned adjacent the top surface 16 of the boot 18. Forward edge 17 is an outermost portion of the second toe strap portion 8 that, when positioned on the toe area of the boot 44 (see FIG. 1A), is located most distal from a heel 40 of the boot 18. The rearward edge 19 is an innermost portion of the second toe strap portion 8 that, when positioned on the toe area of the boot, is located most proximate the heel 40 of the boot.

In the embodiment depicted in FIGS. 2A-2D, attachment section 15 includes an upper edge 21, a lower edge 23, a back surface 45 and a front surface 53. The front and back surfaces 53, 45 may be curved in a side-to-side direction that approximates the shape of the forward wall 24 of the boot 18. The upper edge 21 is an uppermost portion of the section 15 that, when positioned on the forward wall 24 of the boot 18, is located most distal of snowboard 52 or base 89 of the binding 68 (see FIG. 1A). The lower edge 23 is a lowermost portion of the attachment section 15 that, when positioned on the forward wall 24 of the boot 18, is located most proximate the snowboard 52 or binding base 89.

As described above, attachment section 15 extends forwardly and downwardly from the upper section 14. In one embodiment, such as shown in FIG. 2D, the upper edge 21 is stitched to the forward edge 17 of the upper surface 14, although any other suitable attachment technique may be employed, as the present invention is not limited in this respect. For example, the upper section 14 and attachment section 15 may be a unitary component.

Attachment section 15 extends from the upper section 14 in a manner such that the back surface 45 extends at an angle 42 from the bottom surface 33 of the upper section 14 forming a cup-like shape. In one embodiment, angle 42 is less than 180°. In another embodiment, angle 42 is approximately 90°, which may be beneficial when the forward wall 24 of the boot 18 is generally perpendicular to the top surface 16 of the boot 18 at the tip 44 of the boot 18. Although in one embodiment attachment section 15 extends generally perpendicular from the upper section 14, the present invention is not limited in this respect, as any suitable orientation of the attachment section relative to the second toe strap portion to simultaneously resist upward and forward movement may be employed. Angle 42 may also depend upon the degree of tightness or boot retention desired or the shape and configuration of the tip of the boot, for example, the angle between the top surface 16 of the boot 18 adjacent the tip 44 and the forward wall 24. In other embodiments, angle 42 may be any angle between 50° and 140°. The position of the upper section relative to the attachment section and/or strap 8 may also serve to aid in positioning the strap 10 relative to the boot. In this regard, a rider need only position the strap 10 such that the upper section 14 lies on top of the boot and the attachment section and/or strap 8 will align with the boot in the desired position.

Figure 2C:
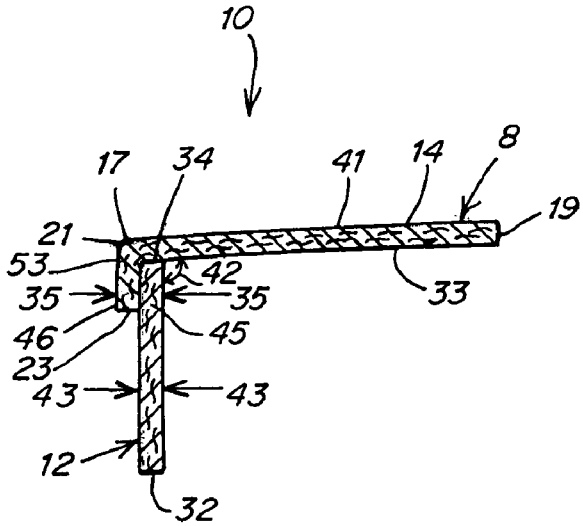
FIG. 2C is a cross-sectional view of the convertible toe strap of FIG. 2A taken along line 2C-2C of FIG. 2A.
Figure 2B:
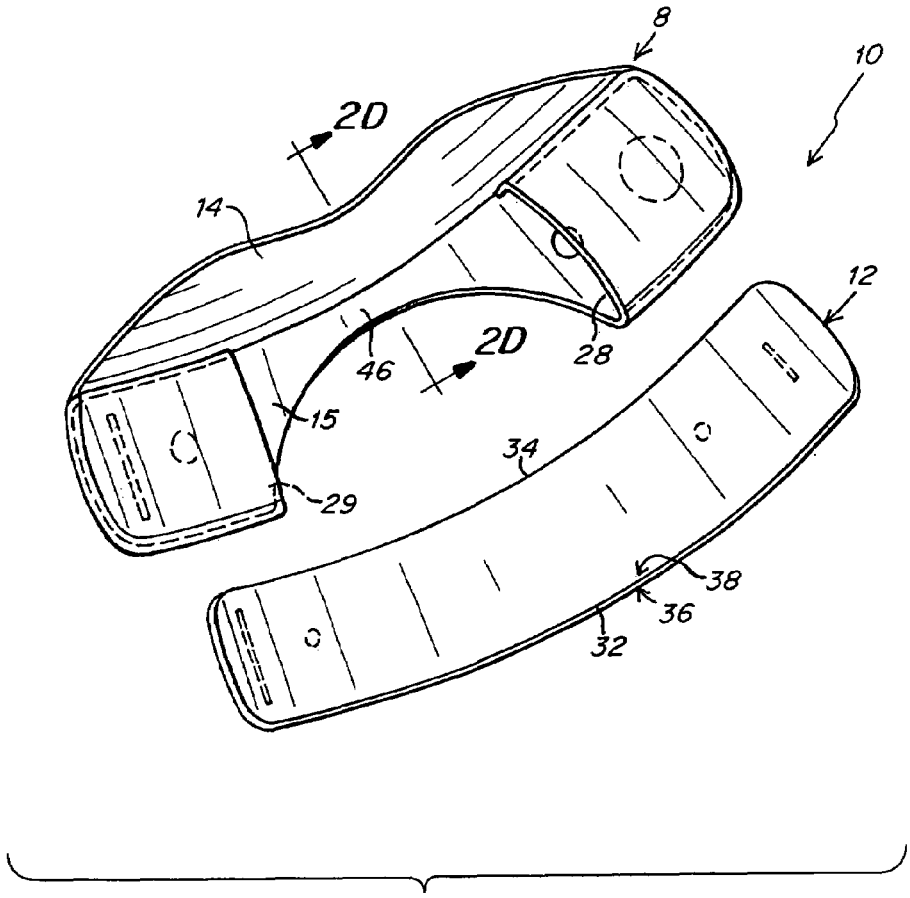
FIG. 2B is an exploded view of the convertible toe strap of FIG. 2A.
Figure 2D:
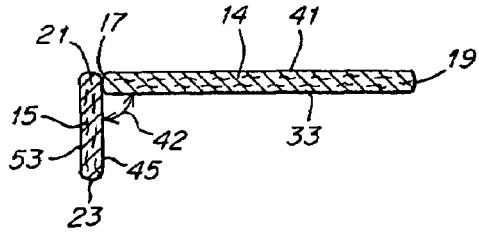
FIG. 2D is a cross-sectional view of a portion of the convertible toe strap of FIG. 2B taken along line 2D-2D of FIG. 2B.

As shown in the embodiment in FIGS. 2A-2D, to aid in increasing the stability of the second toe strap portion 8, a middle section 46 of material extends between the pockets 28, 29. This middle section may be shaped to limit the forward extent or the toe strap when in the second configuration. For example, in the embodiment shown in FIG. 2A, a semi-circular shaped section of material is removed from the lower portion of the middle section 46. As can be seen in the embodiment of FIG. 2C, area 35 extends more forwardly than the area 43 where a section of material was removed. Shaping the middle section in this manner may reduce the overall toe drag experienced by the rider and may also increase the flexibility when inserting the first toe strap portion into the pockets 28, 29. It should be appreciated, however, that the present invention is not limited in this respect and the middle section may be shaped into any suitable configuration.

As best shown in FIG. 2A, in one embodiment, the second toe strap portion 14 may be generally triangular in shape with a base (b) of the triangle being approximately 5 inches long and each side (s) of the triangle being about 3-3½ inches. The apex of the triangle may include a slight radius (r1) and in one embodiment, the radius is about 1½ inches. Attachment section 15 spans the sides of the triangular shaped portion 14 and has a height (h) of approximately 1¾ inches. The pockets may extend along a length (l) of approximately 1½ inches. The semi-circular area of removed material results in an arc-shaped area having a radius of curvature (r2) of approximately 1½ inches. It should be appreciated that the foregoing dimensions are exemplary only and not all embodiments are sized similarly. For example, when in the second configuration, the attachment section 15 may have a shape that is rectangular, strip-like, triangular or any other shape and may be curved to complement the curvature of the forward wall 24 of the boot 18. The upper section 14 may have a shape that is triangular, semi-circular, crescent or any other shape and may be flat or curved and may further complement the surface characteristics of the top surface 16 of the boot. Further, the upper section may be formed with a relatively stiff material (such as a strip of PVC) sandwiched between upper and lower leather-like layers. Section 15 may be formed of leather, fabric or another more supple material such that it can bend and flex to accommodate the insertion of a stiffer first toe strap portion 12.

Figure 4:
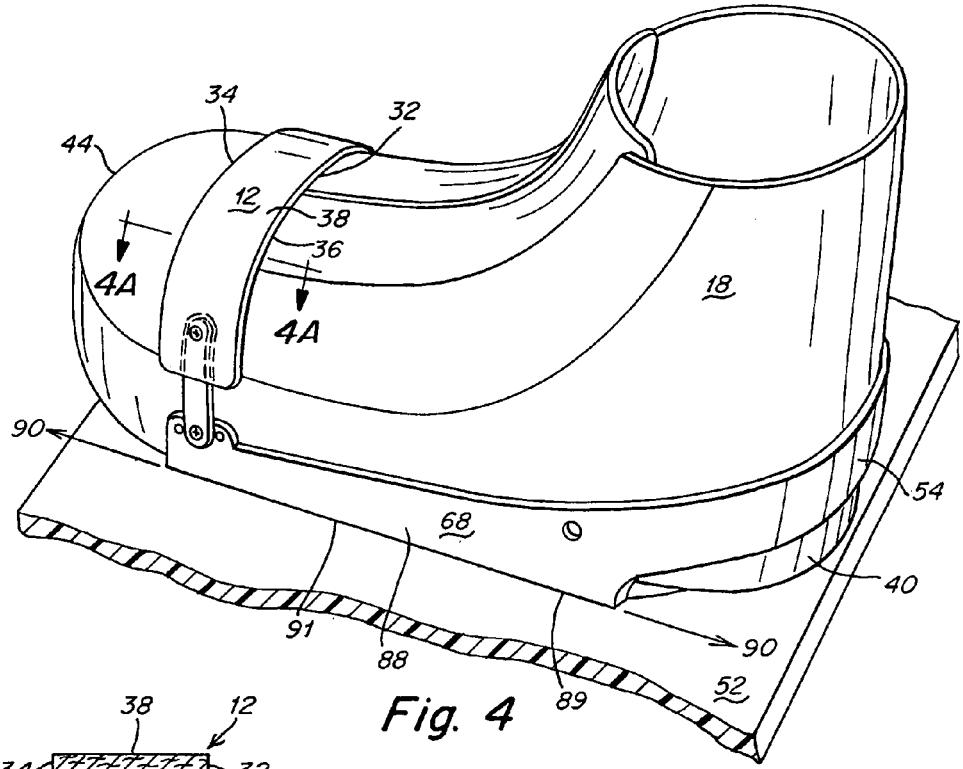
FIG. 4 is a perspective view of another embodiment of a convertible toe strap attached to a binding, which is mounted to a snowboard, and engaging a portion of a snowboarding boot.
Figure 4A:
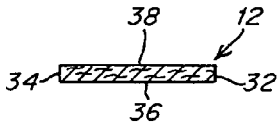
FIG. 4A is a cross-sectional view of the convertible toe strap of FIG. 4 taken along line 4A-4A of FIG. 4.

The construction of the first toe strap portion 12 will now be described in more detail, also with reference to FIGS. 2A-2D and FIGS. 4 and 4A. The first toe strap portion 12 may include a concave edge 32, a convex edge 34, a bottom surface 36, and a top surface 38 as is shown in FIGS. 4&4A. When engaging a boot 18, bottom surface 36 lies adjacent and substantially aligned with the top surface 16 of the boot 18. The convex edge 34 is an outermost portion of the first toe strap portion 12 that, when the convertible toe strap 10 is in a first configuration, is located most distal the heel 40 of the boot 18. The concave edge 32 is an innermost portion of the first toe strap portion 12 that, when the convertible toe strap 10 is positioned in a first configuration, is located most proximate the heel 40 of the boot 18.

Although providing a curved strap may provide certain advantages, such as, for example, increased comfort, reduction of pressure points, and aesthetics, it should be appreciated that the present invention is not limited in this regard, as an oppositely shaped curve (e.g., convex edge 34 is more proximate the heel 40 of the boot 18 than the concave edge 32) or no curve at all need be employed.

In addition to the curvature of the edges, the surfaces 36, 38 of the strap may be bowed to approximate the shape of the top surface 16 of the boot 18. In one embodiment, the bottom surface 36 of the first toe strap portion 12 may be concave, while the top surface 38 is convex. However, it should be appreciated that the strap may have any bow shape or no bow at all, as the convertible toe strap is not limited in this respect.

In one embodiment, when laid flat, the first toe strap portion 12 is slightly arc-shaped, with a length that is sufficient to extend across the top of the boot 18. In one embodiment, the strap portion 12 has a length of approximately 6½ inches and a width of approximately 1½ inches. Although the first toe strap portion may be specially constructed to cooperate with the second toe strap portion, the present invention is not limited in this respect, as a conventional toe strap may be employed to cooperate with one of more embodiments of the second strap portion described herein.

In one embodiment, strap portion 12 is stronger and has a relatively thicker cross-section than upper section 14 of strap portion 8. This may be beneficial because when in the second configuration, most of the tightening load is transferred through the strap portion 12 due at least in part to the coupling of the strap 10 to the binding primarily through the strap 12. On the other hand, upper section 14, experiences relatively less load when the strap 10 is tightened. Although upper section 14 carries less load, nevertheless, in one embodiment, it is not stretchable such that the amount of force it does experience is able to transfer through section 14. Further strap 12, in one embodiment, has relatively more padding whereas section 14 has less. This may be beneficial as most of the pressure a rider will likely experience is a result of the force exerted on the strap portion 12 rather than the force on the upper section 14. This relatively more padding can aid in reducing rider discomfort.

It should be appreciated that the present invention is not limited to the specific embodiments discussed above, as any suitable shape, size and/or material or any suitable combination of shapes, sizes and/or materials may be employed.

As discussed above, the first and second strap portions 8, 12 can be joined with the use of pockets formed on the second strap portion into which the ends of the first strap portion are inserted. However, it should be appreciated that the present invention is not limited in this respect as other arrangements to couple the two strap portions may be employed. Examples of such arrangements include the use of zippers, snaps, buttons, hooks, loops, hoop and loop fasteners such as Velcro™, tabs, elastics, screws, any combination thereof or any other attachment device, and may also have any shape or orientation, as long as it can attach the first toe strap portion to the second toe strap portion. Also, as mentioned, the conversion between the first and second configurations can be accomplished in a variety of ways. Strap embodiments incorporating some of these techniques will now be described.

Figure 3A:
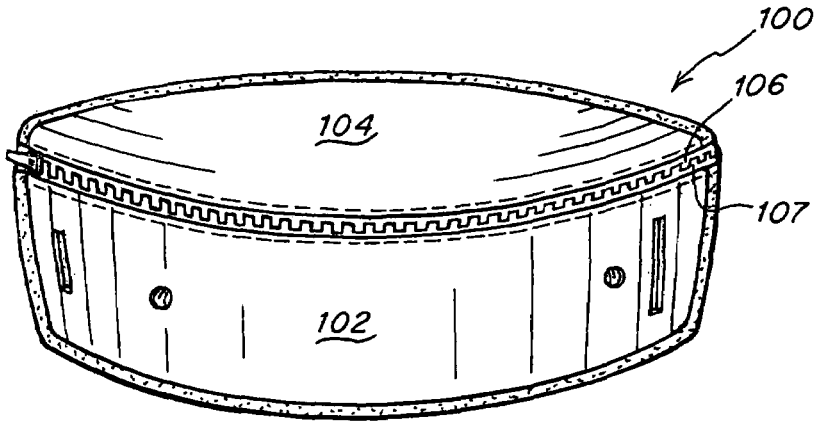
FIG. 3A is a perspective view of one embodiment of a convertible toe strap.

In one embodiment shown in FIG. 3A, a convertible toe strap 100 includes a first toe strap portion 102 and a second toe strap portion 104. These two portions may be attached together with a zipper. In this regard, a first zipper half 107 is formed or stitched to an upper portion of the first strap portion 102 and a second zipper half 106 is formed or stitched to a forward portion of the second strap portion 104.

In the second configuration, as shown, the zipper teeth 107 of the first toe strap portion 102 are zippered to the zipper teeth 106 of the second toe strap portion 104, creating a cup-like toe strap. Subsequent tightening of the strap about the boot holds the toe end down and back in the binding. To convert the convertible toe strap 100 to the first configuration, the two portions are unzipped and the strap portion 102 (with buckle and mounting strap—not shown) is placed in a desired location to tighten onto the boot (e.g., pushing the toe of the boot down or pulling the toe back into the binding).

Figure 3B:
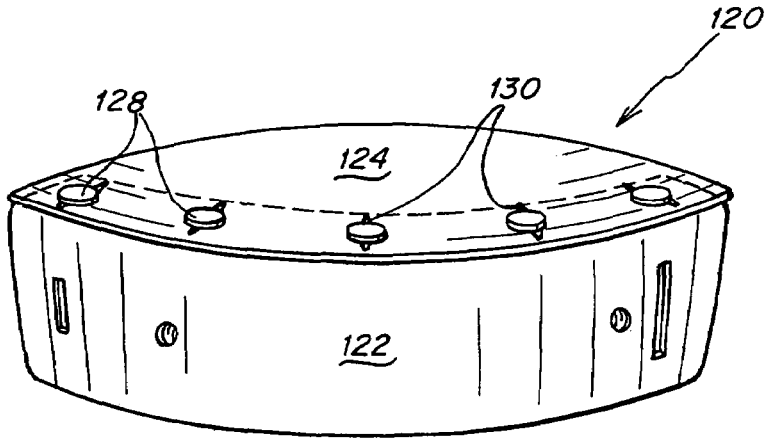
FIG. 3B is a perspective view of another embodiment of a convertible toe strap.
Figure 3C:
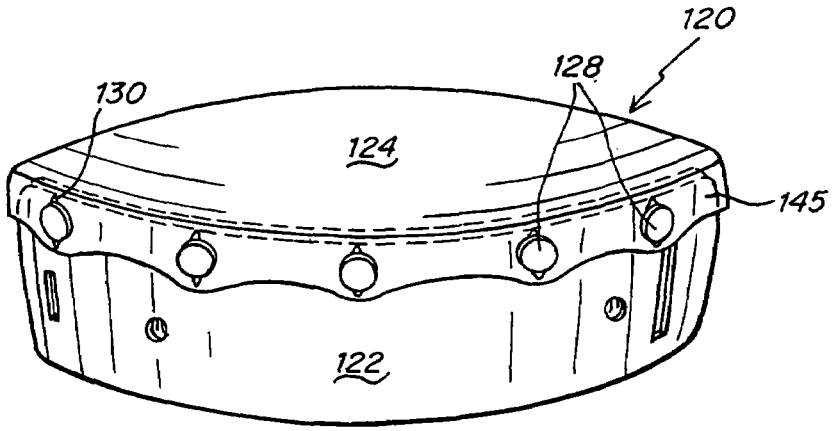
FIG. 3C is a perspective view of another embodiment of a convertible toe strap.

In addition to or in lieu of using a zipper, buttons or snaps may be used to attach a first toe strap portion to a second toe strap portion, such as shown in the embodiments depicted in FIGS. 3B and 3C. In the embodiment shown in FIG. 3B, the convertible toe strap 120 includes a first toe strap portion 122 having buttons 128 mounted thereon. A second toe strap portion 124 includes button holes 130 for receiving buttons 128 to connect the first toe strap portion 122 to a second portion 124, thereby converting the convertible toe strap 120 between a first configuration and a second configuration. The button and button hole arrangement may be positioned such that they lie in an upper region of the strap 120, as shown in FIG. 3B. Alternatively, the button and button hole arrangement may be positioned such that they lie in a forward region of the strap, as shown in FIG. 3C. It should be appreciated that the button and button hole locations may be reversed, such that the buttons are formed on the second strap portion and the button holes are formed on the first, as the present invention is not limited in this respect. Further, although the figures show five buttons holding the two strap portions together, the present invention is not limited in this respect as more or less may be used. Also, some button holes and some buttons may be located on one strap portion while the corresponding buttons and holes may be located on the other strap portion, such as in an alternating pattern.

In another embodiment, the button and/or button holes are located on a flap extension of either the first and second (or both) strap portions. Such an embodiment is shown in FIG. 3C, where the button holes are formed in flap 145 extending from the second strap portion.

Figure 3D:
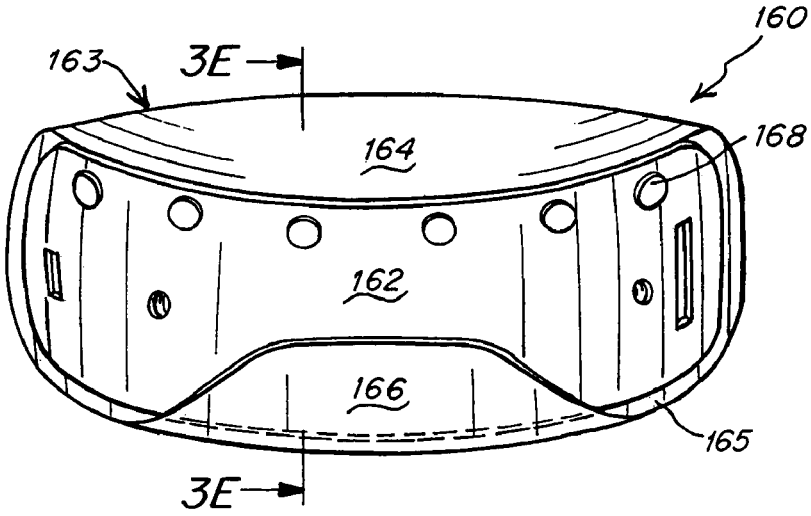
FIG. 3D is a perspective view of another embodiment of a convertible toe strap.
Figure 3E:
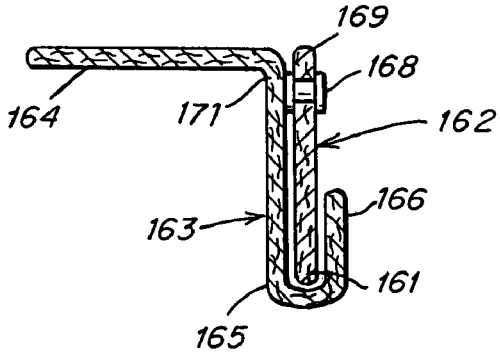
FIG. 3E is a cross-sectional view taken along line 3E-3E of FIG. 3D.
Figure 3F:
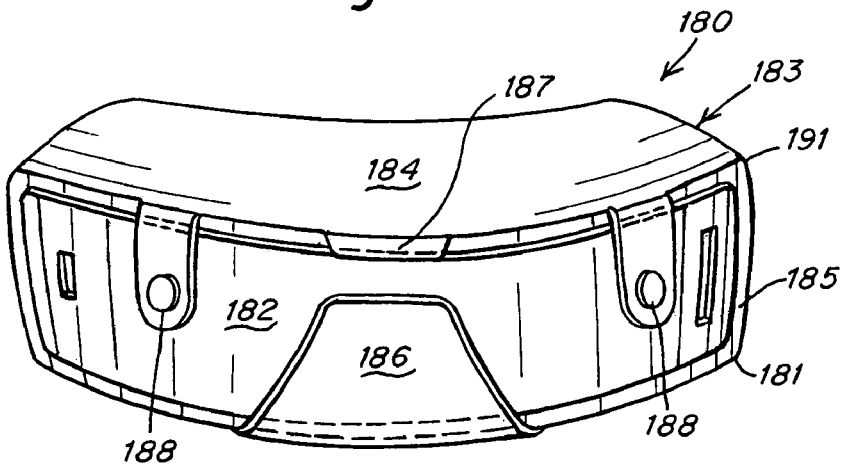
FIG. 3F is a perspective view of another embodiment of a convertible toe strap.

Buttons or snaps can be used in combination with another attachment device, such as in the embodiments shown in FIGS. 3D-F. In the embodiment shown in FIGS. 3D and 3E, the convertible toe strap includes a first toe strap portion 162 and a second strap portion 163. The second toe strap portion 163 includes an upper boot-engaging portion 164 and an attachment portion 165, in the form of a hook 166 located on a lower edge thereof. Snaps or snap receptacles 168 may be located on the upper edge 171 of the attachment portion 165.

Corresponding snap receptacles or snaps 168 may be located on the upper edge 169 of the first toe strap portion 162.

To convert the convertible toe strap 160 into the second configuration, the lower edge 161 of the first toe strap portion 162 may be inserted into the hook 166. Once inserted, the two strap portions are snapped together via snaps/receptacles 168 to secure the strap portions 162, 163 together.

In the embodiment shown in FIG. 3F, the convertible strap portion 180 includes a first toe strap portion 182 and a second strap portion 183. The second strap portion 183 includes a boot-engaging area 184 and an attachment portion 185, which includes a hook 186 at the lower edge 181 of the attachment portion 185. The attachment portion 185 may further include a stop 187, which is located at the upper edge 191 of the attachment portion 185, and snaps 188, which extend down from the upper edge 191 of the attachment portion 185 via flaps. The first toe strap portion 182 may include snap receptacles into which the snaps 188 may be inserted.

In converting the convertible toe strap 180 into the second configuration, the first toe strap portion 182 may be hooked into the hook 186 of the second strap portion 183. To further restrain the first toe strap portion 182, the stop 187 may prevent the first toe strap portion 182 from slipping upwards and out of the hook 186. Snaps 188 may be inserted into the snap receptacles on the first toe strap portion 182 to further secure the first toe strap portion 182 to the convertible strap portion 183.

Figure 3G:
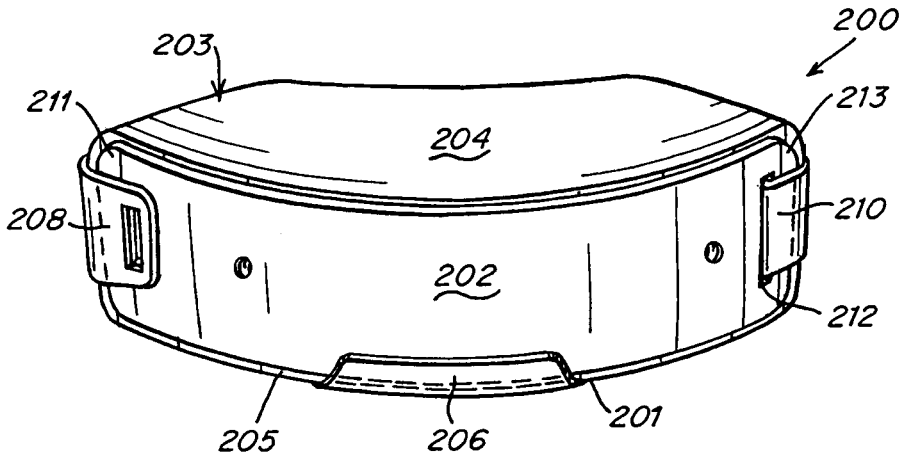
FIG. 3G is a perspective view of another embodiment of a convertible toe strap.

Similar to the embodiment depicted in FIG. 3F, the embodiment of the convertible toe strap 200 shown in FIG. 3G includes a first toe strap portion 202, a second strap portion 203 having boot-engaging area 204 and an attachment portion 205. The attachment portion 205 may include a hook 206 located on a lower edge 201 of the attachment portion 205 and tabs 208, 210 respectively located on a first and second ends 211, 213 of the attachment portion 205. The first toe strap portion 202 may contain a slot 212 on the second end 213 that is constructed and arranged to receive the tab 210.

To convert the convertible toe strap 200 into the second configuration, the first toe strap portion 202 may be hooked into the hook 206 of the second strap portion 203. The first toe strap portion 202 may then be secured by tabs; tab 208 may wrap around the front of the first toe strap portion 202 and/or the tab 210 may wrap around and tuck into the slot 212 on the first toe strap portion 202. In addition, suitable locking elements may be used to secure the tabs.

Figure 3H:
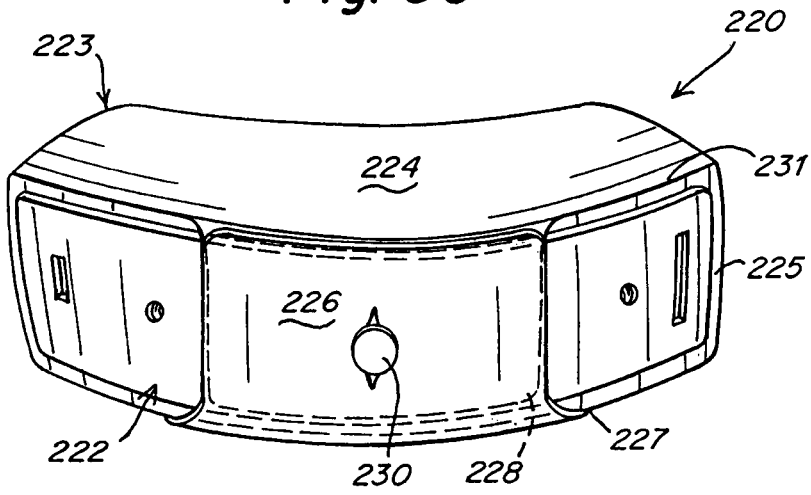
FIG. 3H is a perspective view of another embodiment of a convertible toe strap.

The embodiment in FIG. 3H shows a convertible toe strap 220 including a first toe strap portion 222 and a second strap portion 223 having an upper boot-engaging section 224 and an attachment portion 225. The attachment portion may wrap around or envelop the first toe strap portion 222. Specifically, the attachment portion may include a bottom flap 226 that extends from a lower edge 227 of the second strap portion 223 and a top flap 228 that extends from an upper edge 231 of the second strap portion 223. In one embodiment, the bottom flap 226 may attach to the upper flap 228 by any suitable arrangement, such as a button 230 (of course, snaps, hook and loop fasteners, and other closures may be employed as the present invention is not limited in this respect). In another embodiment (not shown) the bottom and upper flaps may be biased to retain a closed, overlapping position, as the present invention is not limited in this respect.

To convert the convertible toe strap 220 into the second configuration, the flaps 226, 228 may be opened, the first toe strap portion 222 may be placed between the open flaps 226, 228 and the attachment portion 225, and the flaps 226, 228 may be closed to envelop the first toe strap portion 222. In addition or alternatively, the first toe strap portion 222 may be slid into the space between the flaps and the attachment portion 225 from a side while the flaps are closed.

In addition to the diaper-like, flap embodiment of FIG. 3H, the attachment portion may include pockets on one or both ends of the strap to further secure the first toe strap portion. As shown in the embodiment in FIG. 31, the convertible toe strap 240 may include a first toe strap portion 242 and a second strap portion 243 having an upper, boot-engaging strap portion 244 and an attachment portion 245. The attachment portion 245 may include two end pockets 248 and a center loop 246, which may or may not have an open lower end.

The convertible toe strap 240 may be converted into the second configuration by sliding the first toe strap portion 242 into the two end pockets 248 of the attachment portion 245 and then looping the center loop 246 around the first toe strap portion 242 to further secure the first toe strap portion 242 to the convertible strap portion 243. Alternatively, in another embodiment where the center loop is attached at its lower end, one end of the first strap portion is slid through the center loop and into one pocket. The other first strap end is then slid into the other pocket.

Figure 3I:
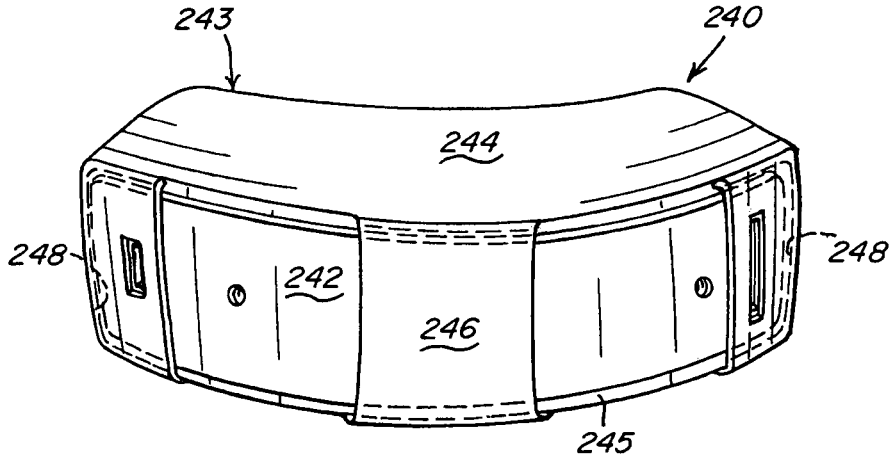
FIG. 3I is a perspective view of another embodiment of a convertible toe strap.
Figure 3J:
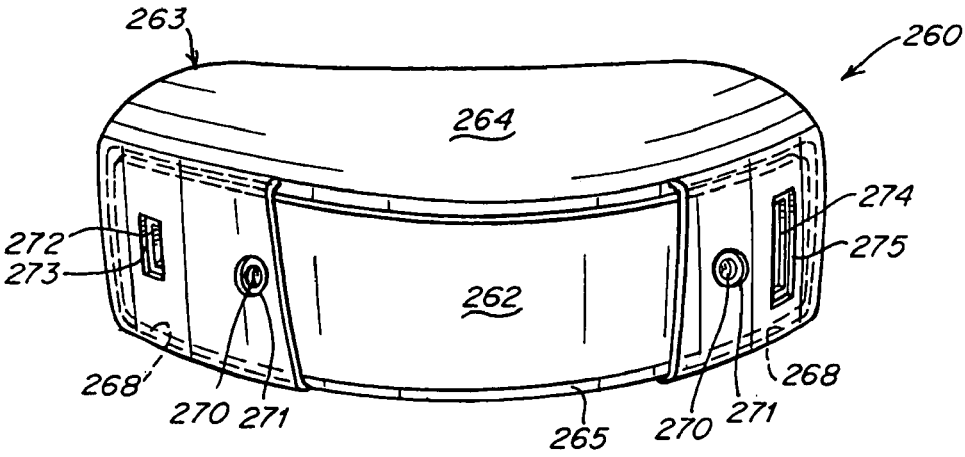
FIG. 3J is a perspective view of another embodiment of a convertible toe strap.

The convertible toe strap need not have a loop, such that the first toe strap portion may be secured to the second toe strap portion by pockets alone, as is shown in the embodiment of FIG. 3J (which is similar to the embodiments described above with reference to FIGS. 2A-2D). In this embodiment, a convertible toe strap 260 includes a first toe strap portion 262 and a second strap portion 263 having boot-engaging portion 264 and an attachment portion 265. The attachment portion 265 may include two end pockets 268. In one embodiment, pockets 268 may extend over a greater area than pockets 248 of the previously described embodiment (FIG. 3I) because the pockets 268 are intended to secure the first toe strap portion 262 to the second toe strap portion 264 without the assistance of another means of attachment, such as a loop 246.

The first toe strap portion may include holes 270 or slots 272, 274 for attaching a mounting strap and/or ratchet buckle. To expose these holes/slots in the first strap portion, the pockets 268 may include openings 271, 273, 275 therein.

Figure 3K:
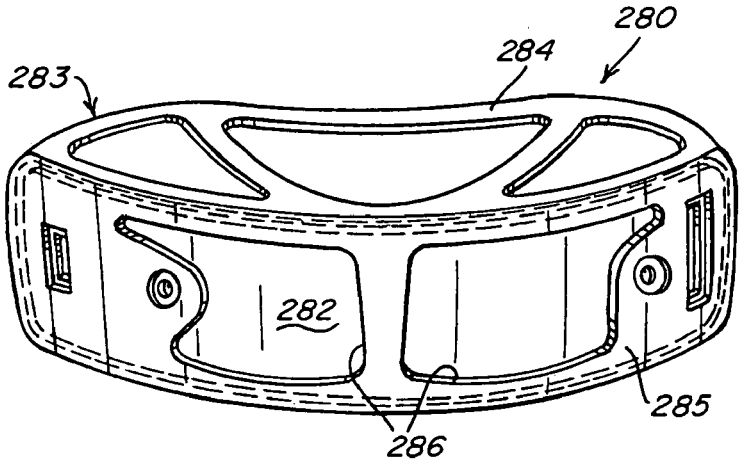
FIG. 3K is a perspective view of another embodiment of a convertible toe strap.
Figure 3L:
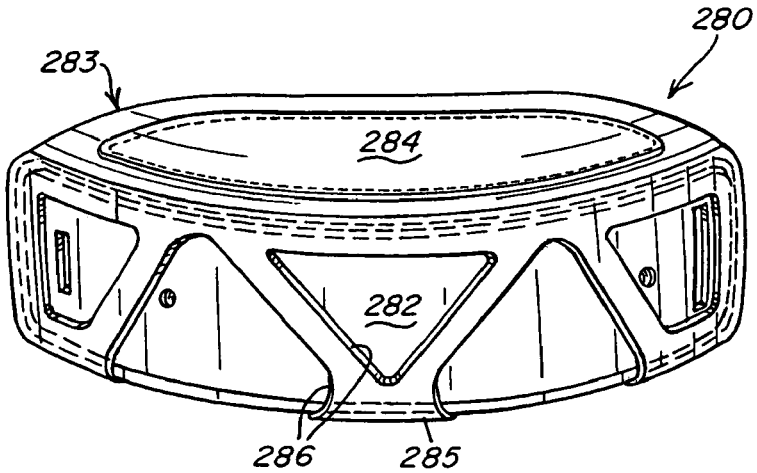
FIG. 3L is a perspective view of another embodiment of a convertible toe strap.

Certain embodiments may provide a flexible convertible strap portion that is elastic or malleable enough to accommodate insertion of the first toe strap portion. FIGS. 3K and 3L depict embodiments wherein the convertible strap portion 283 may be manipulated about the first toe strap portion 282 to encase it. In one embodiment, the convertible toe strap 280 includes a first toe strap portion 282 and a second strap portion 283 having a boot-engaging toe strap portion 284 and an attachment portion 285. The attachment portion 285 of the convertible strap portion 283 may be made from a less flexible material, such as injection-molded plastic, and may contain cut-outs 286 or holes to provide increased flexibility to enable the attachment portion 285 to deform enough to allow insertion of the first toe strap portion 282.

Figure 3M:
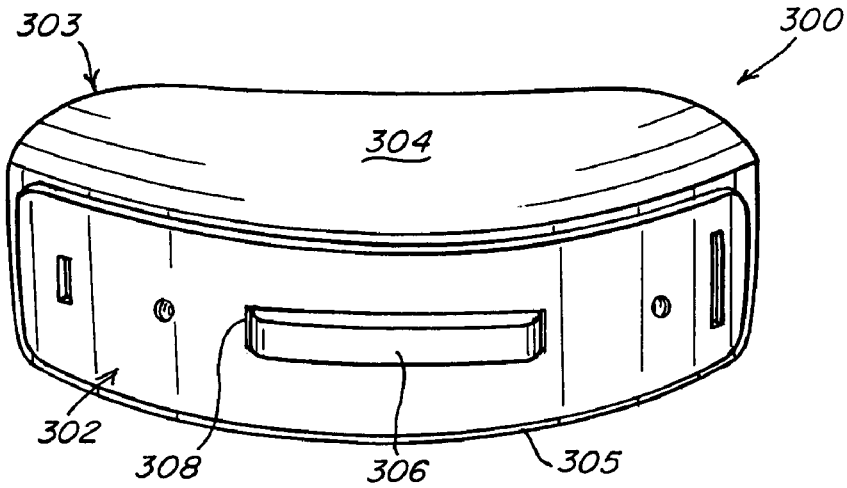
FIG. 3M is a perspective view of another embodiment of a convertible toe strap.
Figure 3N:
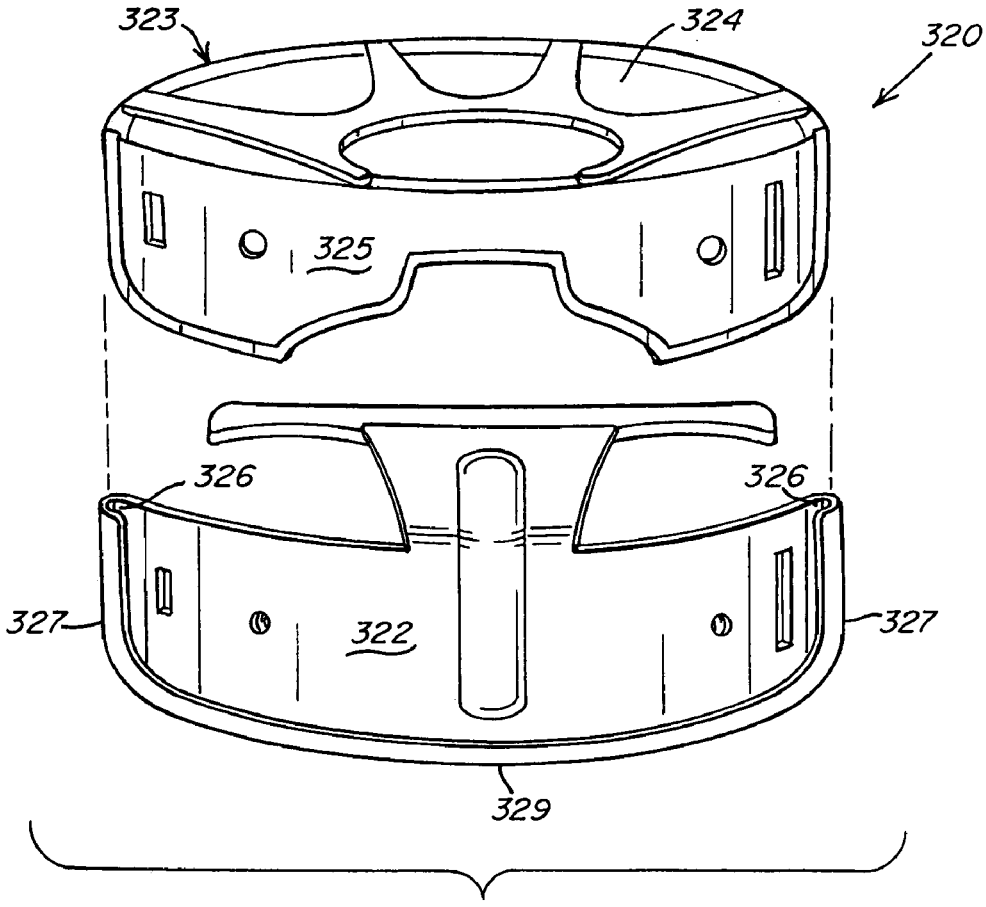
FIG. 3N is an exploded view of another embodiment of a convertible toe strap.

As opposed to a convertible toe strap that may be able to accommodate conventional toe straps as described above, some embodiments may have a particular feature on one of the convertible toe strap portions that only affords them a match with another specific convertible toe strap portion, such as are shown in the embodiments of FIGS. 3M and 3N. The convertible toe strap 300 may include a first toe strap portion 302 and a second strap portion 303, which includes a boot-engaging portion 304 and an attachment portion 305. The attachment portion 305 may have a projection or a plug 306 that may be constructed and arranged to fit through a hole 308 located on the front toe strap portion 302 to connect the convertible toe strap portions together. The plug 306 need not be rectangular, as shown in the embodiment of FIG. 3M, and may have any shape as the present invention is not limited in this respect.

In the embodiment shown in FIG. 3N, the convertible toe strap 320 includes a first toe strap portion 322 and a second strap portion 323. The first toe strap portion 322 may include grooves 326, located on the side edges 327 and/or bottom edge 329 thereof. The second strap portion 323 may include a boot-engaging strap portion 324 and an attachment portion 325. The attachment portion 325 may be constructed and arranged to slide directly into grooves 326 on the edges 327, 329 of the first toe strap portion 322. These grooves alone (e.g., snap fit relation) or in addition to other attachment techniques or arrangements, such as screws, connect the first and second toe strap portions 322, 324 together.

Figure 30:
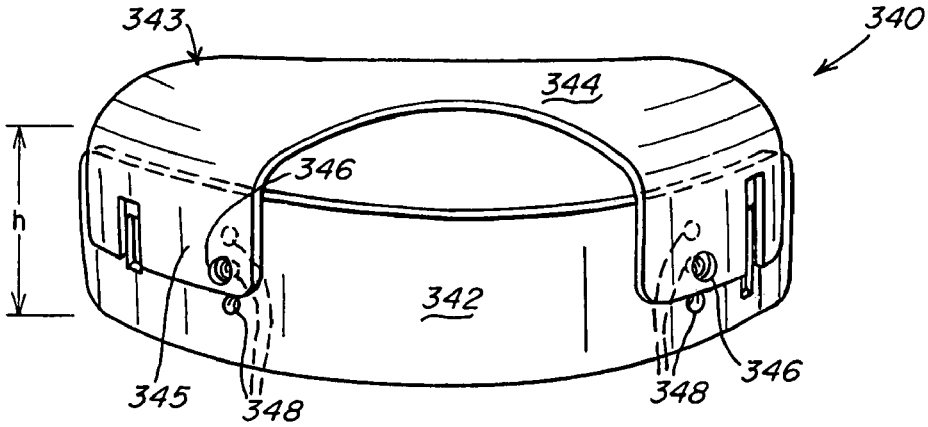

In the embodiment depicted in FIG. 30, the convertible toe strap 340 includes a first toe strap portion 342 and a second strap portion 343, having a boot-engaging strap portion 344 and an attachment portion 345. The attachment portion 345 may include fastening holes 346, such as one or more threaded screw holes, which may be aligned with one or more vertically spaced fastening holes 348, located on the first toe strap portion 342. A screw (not shown), may be screwed into the holes 346, 348 and secured by using a tool, such as a screwdriver. A rider may select a suitable hole to align with the screw to adjust the height (h) of the second strap portion 343 relative to the first strap portion 342.

Figure 3P:
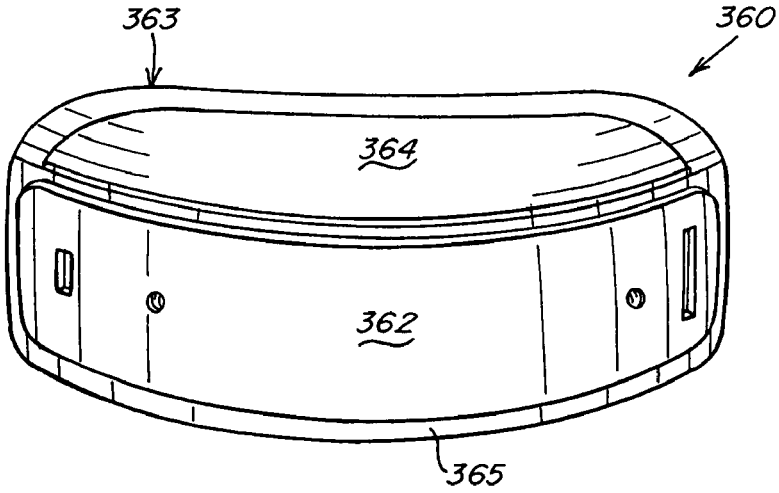
FIG. 3P is a perspective view of another embodiment of a convertible toe strap.

In another embodiment shown in FIG. 3P, the convertible toe strap 360 includes a first toe strap portion 362 and a second strap portion 363 that is cup-like in shape, having a boot-engaging piece 364 and an attachment portion 365. In this embodiment, the attachment portion 365 is more flexible than the boot-engaging piece 364. The attachment portion 365 may be formed as a pocket have an opening (not shown) constructed and arranged to accept the insertion of a first toe strap portion 362. To convert the convertible toe strap 360 into the second configuration, the first toe strap portion 362 may be inserted into the attachment portion 365 to add strength and durability to the portion of the convertible strap portion 363 adapted to engage a forward wall of a boot, thereby enabling the convertible toe strap 360 to restrict movement in both the forward and upward directions.

Figure 3Q:
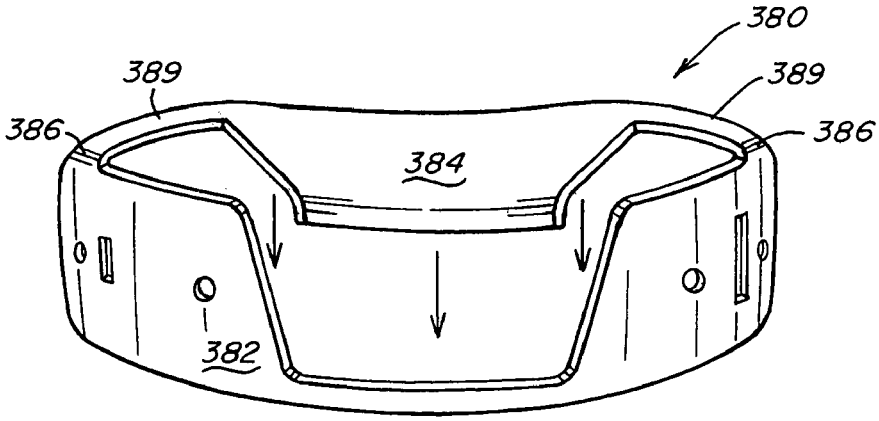
FIG. 3Q is a perspective view of another embodiment of a convertible toe strap.
Figure 3R:
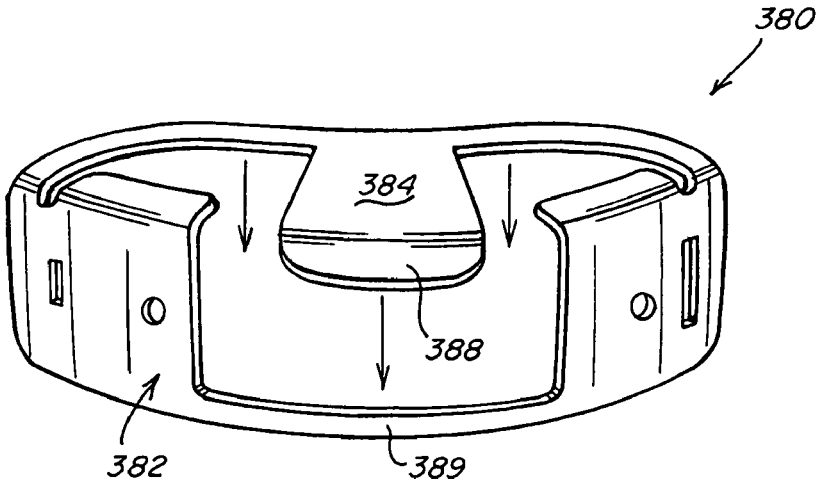
FIG. 3R is a perspective view of another embodiment of a convertible toe strap.

The embodiment in FIG. 3Q depicts a unitary, convertible toe strap 380 having a first portion 382 and a movable second portion 384 that may collapse into the first portion 382 of the convertible toe strap 380, as shown by the arrows. The movable portion 384 may be constructed and arranged to pivot about points 386 and may be biased towards the open position, as shown (e.g., second configuration), thereby acting to hold the boot down. To maintain the strap in a closed position (e.g., first configuration), the movable portion 384 may snap into the first portion such as through an over-center arrangement formed by arms 389. Of course, the strap may be held closed in any other way as the present invention is not intended to be limiting in this manner. The movable portion 384 of the convertible toe strap 380 may include a hook 388 that engages edge 389 to aid in keeping the strap closed, as depicted in the embodiment shown in FIG. 3R.

Figure 3S:
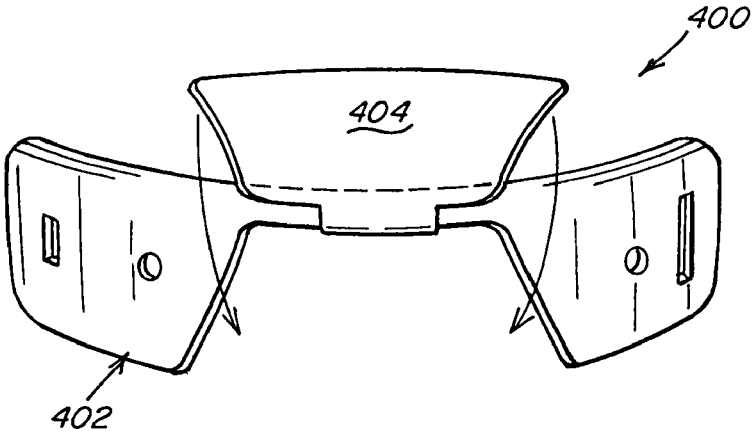
FIG. 3S is a perspective view of another embodiment of a convertible toe strap.

Another embodiment directed to a movable strap portion is shown in FIG. 3S. In this embodiment, the convertible toe strap 400 includes a first portion 402 and a movable portion or center flap 404 that is constructed and arranged to pivot about the first portion 402. To convert the convertible toe strap 400 from the open or second configuration (as shown) into a closed or first configuration (not shown), the center flap 404 may be pivoted downward. To maintain the movable portion 404 in the second configuration, stops (not shown) may be employed. Also, a snap-fit relation may be employed to hold the movable portion 404 closed.

Figure 3T:
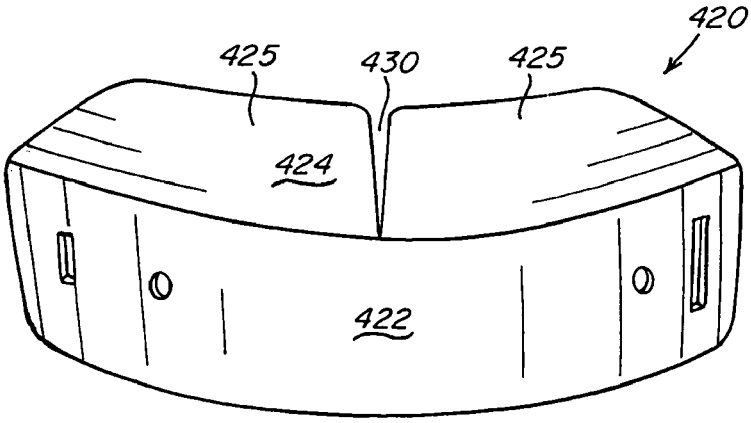
FIG. 3T is a perspective view of another embodiment of a convertible toe strap.

As shown in the embodiment of FIG. 3T, the convertible toe strap 420 includes a first portion 422 and a movable portion 424. The movable portion may include two flaps 425 that are separated by a split 430 therebetween. When the convertible toe strap 420 is in a first configuration, the movable portion 424 is constructed and arranged to separate at the split 430, creating two spaced apart flaps 425. These flaps 425 may be folded over the first portion 422 or may be positioned against a surface of a boot. When the convertible toe strap 420 is converted into a second configuration, the flaps may again come together and may be joined by a snap, button, zipper or any other means of attachment, (not shown) as the present invention is not intended to be limiting in this respect.

Figure 3U:
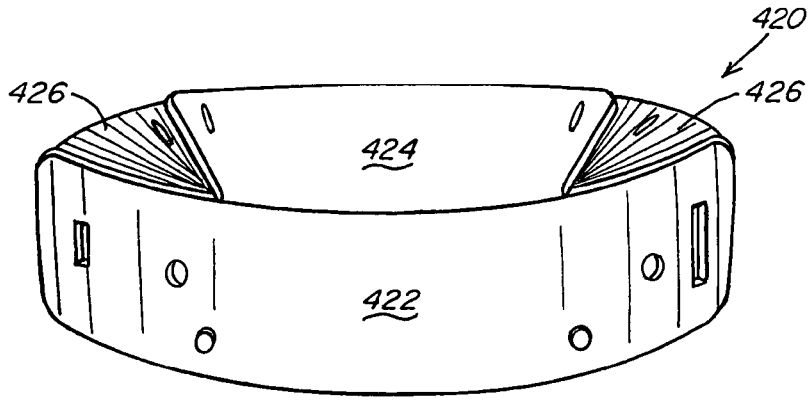
FIG. 3U is a perspective view of another embodiment of a convertible toe strap in a second configuration.
Figure 3V:
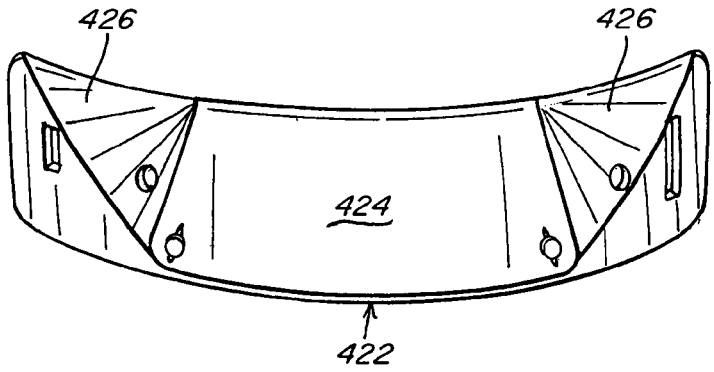
FIG. 3V is a perspective view of the convertible toe strap of FIG. 3U in a first configuration.
Figure 3W:
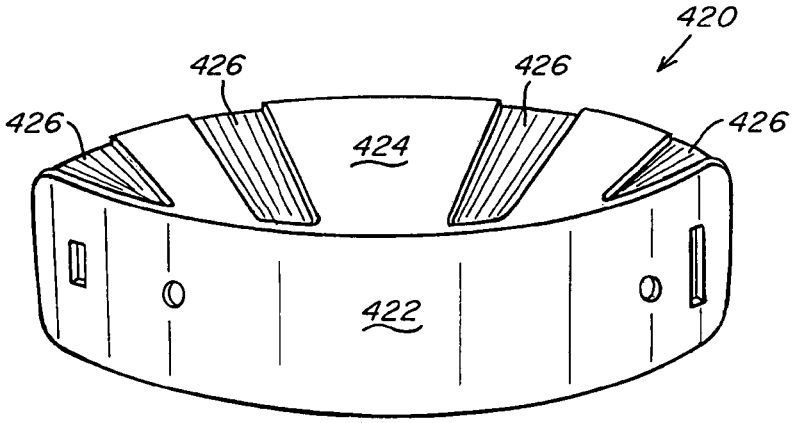
FIG. 3W is a perspective view of another embodiment of a convertible toe strap.

As shown in the embodiments in FIGS. 3U-3W, the convertible toe strap 420 may include a first portion 422 and a movable portion 424, which may include an elastic section 426 at least partially therebetween. The elastic portion 426 may allow the movable portion 424 the flexibility to fold down over the first portion 422, as shown in the embodiment of FIG. 3V. The elastic portion may be configured anywhere along the convertible toe strap 420, such as on the sides of the top portion (as shown in the embodiment of FIG. 3U), in discrete locations along the top portion (as shown in the embodiment of FIG. 3W), along the connection area between the top and forward portions, integrated into the material of the strap, or anywhere else, so long as the top portion 424 can fold onto the forward portion 422, as the present invention is not intended to be limiting in this respect.

It should be appreciated that if any other portion of any embodiment of the convertible toe strap, obstruct access to holes, slots, and/or any other feature to which access may be useful, corresponding openings may be provided in the pockets, or in another portion of the convertible toe strap, to allow access to the holes, slots and/or other features. It should be further appreciated that the obstructing portion of any of the convertible toe straps may include replacement features, such as a threaded hole (not shown), that may perform in a manner similar to the obstructed feature.

Figure 3X:
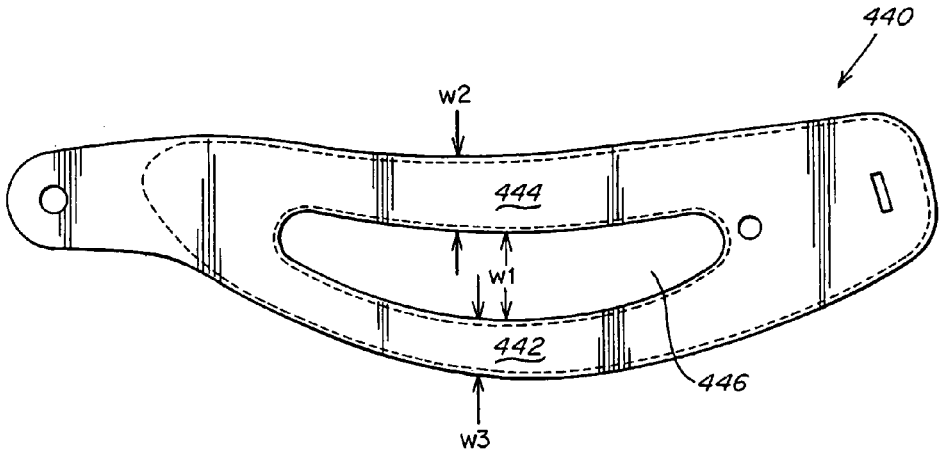
FIG. 3X is a perspective view of another embodiment of a convertible toe strap.

In one embodiment depicted in FIG. 3X, the first and/or second portions 442, 444 may stretch to allow for a conversion between configurations. In one embodiment, at least a section of the convertible toe strap 440 is formed of an elastic or flexible material, thereby enabling the first and/or second portions 442, 444 to move. In one embodiment, in both the first and second configurations, the rearward strap portion 444 may be constructed and arranged to extend about a top surface of a boot. When in the first configuration, the forward portion 442 may be in a contracted configuration as the forward portion 442 need only extend around a top surface of a boot, thereby acting as a toe strap to restrict toe lift. When in a second configuration, the forward portion 442 may be moved downwardly and forwardly to reach around a tip of the boot and extend around a forward wall of the boot.

In one embodiment, the construction of the strap 440, and in particular the shape of the strap opening 446, allows the forward strap portion to move into the second configuration. In one embodiment, the width of the opening (w1) at its center section is greater than the width of each of the strap sections (w2, w3). In another embodiment, the material is sufficiently elastic to allow the movement. The elastic areas may include the forward strap portion 442 itself or may be limited to the sides where it joins strap portion 444.

Although in most embodiments the strap will be self-biased to maintain both the first and the second configurations without external influence, in some embodiments, the strap may require assistance, such as the shape of the boot or fixing to the binding, to maintain one or both configurations, as the present invention is not intended to be limiting in this respect.

It should be appreciated that the convertible toe strap is not limited to the embodiments described above, and may have any configuration and/or arrangement of conversion. It should be further appreciated that the convertible toe strap need not be limited to two configurations. The convertible toe strap may convert from a first configuration to a second configuration to a third configuration.

In one embodiment, the convertible toe strap or portions thereof includes padding, although this is not necessary for all embodiments. When employed, the padding (not shown) may be disposed, for example, on an inner surface to increase comfort or relieve pressure applied by the tip of the boot when the convertible toe strap is tightened. The padding may comprise any material, such as foam, fluid filled chambers such as air or gel pockets, additional layers of fabric, leather or plastic, or any other suitable padding material. In addition to the padding, the strap may include a gripping material on one or more surface (e.g., the underside, boot-facing surface) to aid in holding the strap in position about the boot.

Alternatively or in addition, in one embodiment, the convertible toe strap may be provided with openings or relief cut-outs (not shown) adapted to overlie sensitive areas or pressure points on the foot of the rider to alleviate pressure and further increase the comfort of the convertible toe strap. In one embodiment, the openings are complete cut-outs such that no material overlies the sensitive area and a hole exists in the convertible toe strap. In another embodiment, the relief cut-outs are areas of the convertible toe strap having a lesser thickness of material than another area of the convertible toe strap, but not entirety removed. For example, a relief cut-out area may have a thickness including one layer of material, but the rest of the convertible toe strap will have an increased thickness formed of additional layers of material.

In addition or alternatively, portions of the strap may be decreased in size or thickness to reduce air or snow resistance or drag. As described above and as shown in the embodiment of FIG. 2A-2D, a portion of the middle section of the second toe strap portion may be cut away to reduce toe drag.

Attaching the convertible strap to a mating component, such as a binding, binding interface or boot, will now be described. It should be appreciated that although this attachment arrangement is described with reference to FIGS. 1A, 1B and 4, this arrangement may be employed in any strap embodiment. In one embodiment, the convertible toe strap 10 includes a ratchet buckle 56 mounted at one end, and a fastener (as can been seen in FIGS. 1A and 4) disposed at the opposite end. A first mounting strap 58 (also referred to as an engagement strap or ratchet tongue) and second mounting strap may be used with the convertible toe strap 10 to attach the strap (e.g., to a base of a snowboard binding). In the embodiment shown in FIG. 1B, the first mounting strap 58 includes a serrated portion 60 to engage the ratchet buckle 56. The second mounting strap may be secured on the opposite end of the convertible toe strap 10 by the fastener. The ends of the first and second straps opposite the convertible toe strap 10 may be secured to the binding by fasteners 62.

In one embodiment, the ratchet buckle 56 is engagable with the teeth 60 on mounting strap 58, thereby allowing a rider to selectively adjust the tightness and looseness of the convertible toe strap 10 by feeding or withdrawing the strap 58 to or from the ratchet buckle 56. Upon receipt and drawing down of the strap 58, the convertible toe strap 10 is drawn towards the toe area of the boot 18 to hold the boot tip down and back, so that the heel 40 of the boot 18 is seated in the heel hoop 54 of the binding. In an alternative embodiment, the mounting strap 58 is fixed to a side of the convertible toe strap 10 and the ratchet buckle is attached to the binding.

It should be appreciated that the present invention is not limited to any particular arrangement to attach the convertible toe strap 10 to the binding and that suitable arrangement techniques other than those disclosed herein may be employed. For example, the convertible toe strap may be attached indirectly to the binding with the use of a cable or lace, etc. or may be directly fastened to the binding with the use of a suitable fastener, such a T-nut and bolt fastener.

To allow further selective adjustment or easier replacement, as shown in the embodiment of FIGS. 1A and 4, in one embodiment, the second mounting strap 59 may include a plurality of apertures 64. A rider can select a particular aperture to utilize to secure the second mounting strap 59 to the convertible toe strap 10, such that the length of the convertible toe strap and mounting strap combination can be adjusted, thereby adjusting the tightness or the fit of the convertible toe strap 10. In this manner, the mounting strap 59 is slidable relative to the convertible toe strap 10. In one embodiment, screw 65 extends through the convertible toe strap 10, and a T-nut or other fastener engager may be provided in a hole 66 in the convertible toe strap 10 or in one of the apertures 64 of the mounting strap 59, to allow engagement of the screw 65. It should be appreciated that the present invention is not limited to the use of screws, T-nuts or any other fastening device, as any suitable technique to adjustably, removably or fixedly secure the mounting strap 59 to the binding baseplate 68 and/or convertible toe strap 10 can be employed. It should also be appreciated that the mounting strap 59 may be formed integrally with the convertible toe strap 10.

The convertible toe strap 10 may include a pocket 70, loop, channel or other arrangement for holding the free end of the mounting strap 59 to the convertible toe strap 10, examples of which are described in commonly assigned U.S. Pat. No. 6,056,030, which is hereby incorporated by reference in its entirety. In one embodiment, a slit 71 is formed in the second toe strap piece 8 to allow access to the pocket 70 which is formed in the first toe strap piece 12 (see, e.g., FIG. 1A). However, the present invention is not limited in this respect, as the pocket may be formed at other suitable locations or need not be employed at all.

The mounting strap 58 and/or 59 may include one or more holes 72 (see, e.g., FIG. 1A) that allow for selective adjustment of the mounting strap to the binding 68. The binding 68 may also include one or more holes 73 that also allow for selective adjustment of the mounting strap. Any excess mounting strap length extending beyond the binding may be snipped off, tucked in, folded over, or modified or oriented in any other desired way or position. The present invention is not limited in this respect, as adjustment may occur at one end only; alternatively, no adjustment need be employed.

Other suitable mechanisms for attaching the mounting strap to the binding may be employed, as the present invention is not limited in this respect. For example, a tool-free strap attachment arrangement, such as that described in commonly assigned U.S. Pat. No. 6,416,075, which is hereby incorporated herein by reference in its entirety, may be employed.

Due to the orientation of the convertible toe strap 10 relative to the binding, in one embodiment, the mounting strap 59 may have a pre-formed bend or curve. For example, a bent or curved mounting strap, such as described in commonly owned U.S. patent application Ser. No. 10/728,373, filed Dec. 4, 2003, which is hereby incorporated herein by reference in its entirety, may be employed. As seen in the embodiment of FIG. 2A, the mounting strap 59 includes a bend, which may enable more efficient force translation between the strap and binding. Of course, the present invention is not limited to including a mounting strap with a bend.

It should be appreciated that any arrangement or method of attaching the convertible toe strap 10 to the binding 68, the boot 18, the snowboard or binding interface may be used, as the present invention is not limited to any particular attachment arrangement.

As described above, having the concave edge 32 of the first toe strap portion 12 be positioned more proximate the heel 40 of the boot 18 may provide certain advantages. One method of converting the convertible toe strap from the second configuration to the first configuration may include switching a first toe strap portion 12 that, in a first configuration, was attached to a right foot's binding to a left foot's binding. In one embodiment, such as is shown in FIGS. 1A and 1B, when the first toe strap portion 12 is in a second configuration (FIG. 1A), the concave edge 32 is more proximate lower surface 22 of the boot 18 than the convex edge 34. The mounting straps 58, 59, and in some embodiments, the ratchet buckle 56, may be disconnected from the convertible toe strap 10 to remove the second strap portion 8, thereby converting the convertible toe strap 10 into a first configuration. When the mounting straps are reconnected to the first toe strap portion 12, the concave edge 32 will be less proximate the heel 40 of the boot 18 than the convex edge 34. Although this configuration will still prevent toe lift and restrain the boot in the binding, it may be preferable to switch the first toe strap portion 12 from second configuration on the left foot (as shown in the embodiment of FIG. 1A) to the first configuration on the right foot (as shown in the embodiment of FIG. 1B); therefore, the curvature of the first toe strap portion 12 will cooperate with the curvature of the toe of the boot and/or of the ankle, and the concave edge 32 will be more proximate the boot heel, as shown.

Alternatively, the curvature may be maintained by switching the mounting straps 58, 59 on the same binding. Although many riders prefer to have the adjustable buckles, such as a ratchet buckle, on the outside edge of the binding (e.g. ratchet buckles on the right foot would be on the right side of the binding and the ratchet buckles on the left foot would be on the left side of the binding), if the mouthing strap 58 with teeth 60 to be received by the ratchet buckle 56 were switched to the inside edge of the binding, the first toe strap portion 12 need only be flipped 180° to be reattached with the preferred curvature arrangement.

Figures 5, 5A:
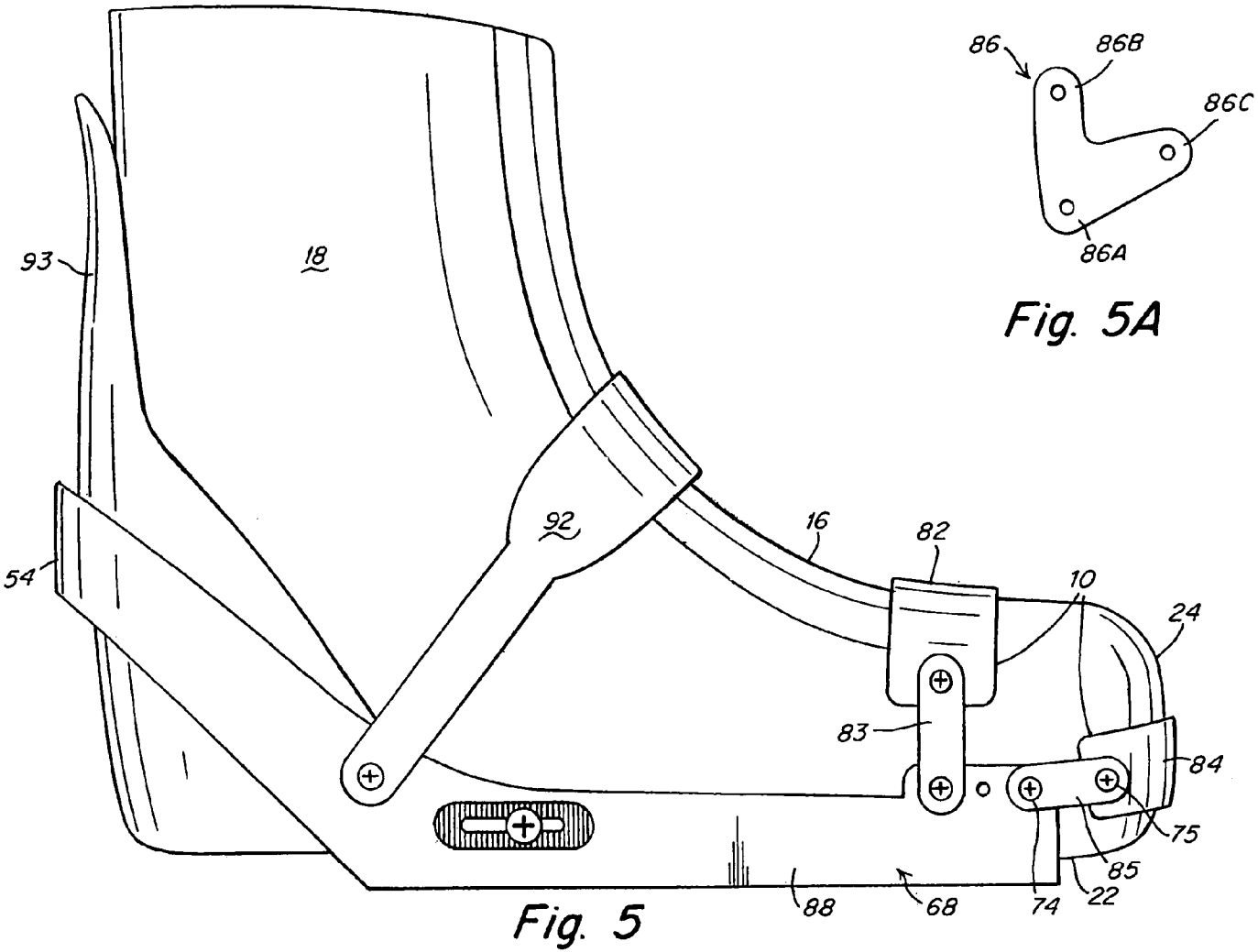
FIG. 5 is a side view of another embodiment of a convertible toe strap attached to a binding and engaging a snowboard boot.
FIG. 5A is a side view of an alternative mounting strap.

In another embodiment and as shown in the embodiment of FIG. 5, the convertible toe strap may include two separate strap pieces (such as a first strap 82 that is not connected to a second strap 84). In a first configuration both straps 82, 84 may be positioned on the top surface 16 of the boot 18 (not shown), the second strap 84 may be removed from the binding 68, the second strap 84 may be positioned underneath the boot 18, near or contacting the lower surface 22, and/or the second strap 84 may be loosened or otherwise adjusted so that it does not provide a normal force on the forward wall 24 of the boot 18 to inhibit movement in the forward direction. In a second configuration the straps 82, 84 may be positioned so that the first strap 82 contacts the top surface 16 to provide resistance to toe-lift and the second strap 84 contacts the forward wall 24 of the boot 18 to provide resistance to forward movement of the boot 18. To convert from the second configuration (as shown in the embodiment of FIG. 5) to the first configuration (not shown), the second strap 84 may be rotated upwards about a fulcrum, such as screw 74, screw 75, or any other point, may be stretched, for example, if the second strap 84 contained an elastic or flexible material, or may be moved in another way, as the present invention is not intended to be limited in this respect.

To enable independent strap portion adjustment and a more customized fit, in one embodiment, the convertible toe strap 10 may include two separate mounting straps 83, 85 connected at one end to the side of the convertible toe strap 10 and at the other end to the side of the binding 68. Separate mounting straps may also be employed on the opposite side of the binding.

Alternatively, to reduce the number of components and connections, the convertible toe strap 10 may be joined to the binding 68 by a single mounting strap 86 (see FIG. 5A) on one or both sides of the convertible toe strap. The single mounting strap 86 may have a single connection point 86A to the binding 68 and thereafter may bifurcate into two sections, 86B and 86C, one of which connects to the first strap 82 and the other of which connects to the second strap 84.

It should be further appreciated that any of the above-described embodiments may be used in combination with a binding 68. The binding 68 may include a frame 88 that is mountable to a snowboard 52 (as shown in the embodiment of FIG. 4). The frame 88 has a length direction 90 and a base 89 that defines a mounting surface 91 that extends generally parallel to the snowboard 52. The frame 88 may be adapted to receive a snowboard boot 18. The frame may include a heel hoop 54. An ankle strap 92 may be attached to the rear portion of the frame 88 and a highback 93 may be mounted to the frame 88 and nested within the heel hoop 54 (as shown in the embodiment of FIG. 5).

In general, it should be appreciated that along with any normal force, resulting frictional forces may occur transverse to the normal force. For example, as shown in FIGS. 1A and 1B, when the convertible toe strap 10 is adapted to engage the top surface 16 of the boot 18, the convertible toe strap 10 will exert a normal force on the top surface 16 of the boot 18. In addition, frictional forces which is a percentage of the normal force and a function of the materials of the convertible toe strap 10 and the top surface 16 of the boot 18, will act to resist movement in a transverse direction.

It should be appreciated that the present invention is not limited to any embodiment described herein and that other suitable embodiments employing one or more features described herein (or other suitable features) may be employed in or with the convertible toe strap.

Having thus described certain embodiments of a convertible toe strap, various alterations, modification and improvements will readily occur to those skilled in the art. Such alterations, modifications, and improvements are intended to be within the spirit and scope of the invention. Accordingly, the foregoing description is by way of example only, and not intended to be limiting. The invention is limited only as defined in the following claims and the equivalent thereof.

What is claimed is:

1. An apparatus for securing a toe area of a snowboarding boot, the toe area of the boot having a top surface, a bottom surface and a front wall extending therebetween, the apparatus comprising:

a convertible toe cap strap having:

a generally cup shape adapted to extend across and overlie the top surface of the boot and to extend around and overlie the front wall of the boot whereby, when the apparatus is tightened about the boot in a cap strap configuration, the convertible toe cap strap conforms to the top surface and the front wall of the boot; and a generally bow shape adapted to extend across and engage to top surface of the boot whereby, when the apparatus is tightened about the boot in a toe strap configuration, the convertible toe cap strap conforms to the top surface of the boot so as to eliminate gaps between the strap and the top surface of the boot;

wherein the apparatus is selectively and repeatedly convertible between the cap strap configuration whereby both upward movement and forward movement of the toe area of the boot is resisted and the toe strap configuration whereby upward movement of the toe area of the boot is resisted.

2. The apparatus according to claim 1, wherein the convertible toe cap strap comprises a first strap piece adapted to extend across and overlie the top surface of the boot, and a second strap piece adapted to selectively extend across and engage the top surface of the boot or extend around and overlie the front wall of the boot, wherein the first and second strap pieces are movable relative to each other.

3. The apparatus according to claim 1, wherein the convertible toe cap strap comprises an elastically deformable material adapted to allow the convertible we cap strap to stretch and contract to allow conversion between configurations.

4. The apparatus according to claim 1, wherein the convertible toe cap strap comprises a first strap piece and a second strap piece removably attachable to the first strap piece.

5. The apparatus according to claim 4, wherein the first strap piece is adapted to extend across and engage the top surface of the boot when the apparatus is tightened about the boot in the toe strap configuration, and wherein the first strap piece is adapted to extend around and overlie the front wall of the boot and the second strap piece is adapted to extend across and overlie the top surface of the boot when the apparatus is tightened about the boot in the cap strap configuration.

6. The apparatus according to claim 1, wherein the convertible toe cap strap comprises a first strap piece adapted to extend across and overlie the top surface of the boot, and a second strap piece adapted to selectively extend across and engage the top surface of the boot or extend around and overlie the front wall of the boot, wherein the first and second strap pieces are spaced-apart from each other.

7. The apparatus according to claim 1, further comprising a first mounting strap adapted to at least partially attach the convertible toe cap strap to a snowboard binding.

8. The apparatus according to claim 7, wherein the first mounting strap is integrally formed with the convertible toe cap strap.

9. The apparatus according to claim 8, wherein first mounting strap comprises a plurality of holes configured for selective adjustment of the mounting strap to the snowboard binding.

10. The apparatus according to claim 9, wherein an excess length of the first mounting strap is adapted to be snipped off.

11. An apparatus for securing a toe urea of a snowboarding boot, the toe area of the boot having a top surface, a bottom surface, a front wall extending therebetween, and a boot tip between the top surface and the front wall, the apparatus being selectively and repeatedly convertible between a cap strap configuration and a toe strap configuration, the apparatus comprising:

a convertible toe cap strap adapted to overlie the top surface of the boot, the front wall of the boot and the boot tip when the apparatus is in the cap strap configuration, wherein the apparatus resists upward movement and resists forward movement, or to engage the top surface of the boot when the apparatus is in the toe strap configuration so as to eliminate gaps between the strap and the top surface of the boot, wherein the apparatus resists upward movement, the convertible toe cap strap being flexible and resilient to allow the convertible toe cap strap to conform to the surface of the boot to which the convertible toe cap strap overlies when the apparatus is tightened about the boot in either configuration.

12. The apparatus according to claim 11, wherein the convertible toe cap strap comprises a first strap piece adapted to extend across and overlie the top surface of the boot, and a second strap piece adapted to selectively extend across and engage the top surface of the boot or extend around and overlie the front wall of the boot, wherein the first and second strap pieces are movable relative to each other.

13. The apparatus according to claim 11, wherein the convertible toe cap strap comprises an elastically deformable material adapted to allow the convertible toe cap strap to stretch end contract to allow conversion between configurations.

14. The apparatus according to claim 11, wherein the convertible toe cap strap comprises a first strap piece adapted to extend across and overlie the top surface of the boot, and a second strap piece adapted to selectively extend across and engage the top surface of the boot or extend around and overlie the front wall of the boot, wherein the first and second strap pieces are spaced-apart from each other.

15. The apparatus according to claim 11, further comprising a first mounting strap adapted to at least partially attach the convertible toe cap strap to a snowboard binding.

16. The apparatus according to claim 15, wherein the first mounting strap is integrally formed with the convertible toe cap strap.

17. The apparatus according to claim 16, wherein first mounting strap comprises a plurality of holes configured for selective adjustment of the mounting strap to the snowboard binding.

18. The apparatus according to claim 17, wherein an excess length of the first mounting strap is adapted to be snipped off.

19. A convertible toe cap strap for securing a toe area of a snowboarding boot, the toe area of the boot having a top surface, a bottom surface, a front wall extending therebetween, and a boot tip between the top surface and the front wall, the convertible toe cap strap being selectively and repeatedly convertible between a cap strap configuration and a toe strap configuration, the convertible toe cap strap comprising:

a first strap piece having a first surface adapted to overlie and conform with the top surface of the boot when the toe cap strap is either in the toe strap configuration, wherein the toe cap strap piece is adapted to resist upward movement, or in the cap strap configuration, wherein the toe cap strap is adapted to resist upward movement and adapted to resist forward movement; and a second strap piece connected to the first strap piece and having a second surface adapted to engage and conform with the top surface of the boot when the toe cap strap is in the toe strap configuration so as to eliminate gaps between the second strap piece and the top surface of the boot and adapted to overlie and conform with the front wall of the boot when the toe cap strap is in the cap strap configuration;

the first strap piece and the second strap piece being separated by an area sufficient to allow the second strap piece to be convened from a top surface-overlying position, wherein the toe cap strap is in the toe strap configuration, into a forward wall-overlying position, wherein the toe cap strap is in the toe strap configuration with the boot tip being positionable between the first and second strap pieces, the area separating the first and second strap pieces adapted to allow conformability of the toe cap strap into any of the configurations.

20. The convertible toe cap strap according to claim 19, wherein the area includes a center section, wherein the first strap piece has a first width and the second strap piece has a second width, and wherein the first and second strap pieces are separated at the center section by a width that is greater than to width of each strap piece.

21. The convertible toe cap strap according to claim 19, wherein the first and second strap pieces are movable relative to each other.

22. The convertible toe cap strap according to claim 19, further comprising an elastically deformable material adapted to allow the convertible toe cap strap to stretch and contract to allow conversion between configurations.

23. The convertible toe cap strap according to claim 19, further comprising a first mounting strap adapted to at least partially attach the convertible toe cap strap to a snowboard binding.

24. The convertible toe cap strap according to claim 23, wherein the first mounting strap is integrally formed with the convertible toe cap strap.

25. The convertible toe cap strap according to claim 24, wherein first mounting strap comprises a plurality of holes configured for selective adjustment of the mounting strap to the snowboard binding.

26. The convertible toe cap strap according to claim 25, wherein an excess length of the first mounting strap is adapted to be snipped off.

* * * * *